US011624555B2

(12) United States Patent
Krishnamurthy et al.

(10) Patent No.: US 11,624,555 B2
(45) Date of Patent: Apr. 11, 2023

(54) METHOD AND SYSTEM FOR COOLING A HYDROCARBON STREAM

(71) Applicant: Air Products and Chemicals, Inc., Allentown, PA (US)

(72) Inventors: Gowri Krishnamurthy, Sellersville, PA (US); Mark Julian Roberts, Whitehall, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 16/826,907

(22) Filed: Mar. 23, 2020

(65) Prior Publication Data

US 2020/0217585 A1 Jul. 9, 2020

Related U.S. Application Data

(62) Division of application No. 15/830,269, filed on Dec. 4, 2017, now abandoned.

(51) Int. Cl.
*F25J 1/00* (2006.01)
*F25J 1/02* (2006.01)
(Continued)

(52) U.S. Cl.
CPC ..... *F25J 1/0022* (2013.01); *F25B 1/10* (2013.01); *F25B 5/00* (2013.01); *F25B 9/008* (2013.01);
(Continued)

(58) Field of Classification Search
CPC ..... F25J 1/00; F25J 1/02; F25J 1/0022; F25J 1/0052; F25J 1/0057; F25J 1/0085;
(Continued)

(56) References Cited

U.S. PATENT DOCUMENTS 2,696,088 A 12/1954 Twomey
3,413,816 A * 12/1968 De Marco ..... F25J 1/0052 62/614
(Continued)

FOREIGN PATENT DOCUMENTS

CN 101805649 8/2010
CN 202692601 1/2013
(Continued)

OTHER PUBLICATIONS

Donald K. McMillan, et al, "Cost Effective Revamping of LNG Plants to Maximize Production Rates at Elevated Ambient Temperatures", International Conference and Exhibition of Liquefied Natural Gas, Apr. 18, 2010.
(Continued)

*Primary Examiner* — Elizabeth J Martin
(74) *Attorney, Agent, or Firm* — Amy Carr-Trexler

(57) ABSTRACT

A system and method for increasing the efficiency of natural gas liquefaction processes by using a hybrid cooling system and method. More specifically, a system and method for converting a transcritical precooling refrigeration process to a subcritical process. In one embodiment, the refrigerant is cooled to sub-critical temperature using an economizer. In another embodiment, the refrigerant is cooled to a sub-critical temperature using an auxiliary heat exchanger. Optionally, the economizer or auxiliary heat exchanger can be bypassed when ambient temperatures are sufficiently low to cool the refrigerant to a sub-critical temperature. In another embodiment, the refrigerant is isentropically expanded.

8 Claims, 14 Drawing Sheets

(51) Int. Cl.

| | |
|---|---|
| ***F25B 9/00*** | (2006.01) |
| ***F25B 1/10*** | (2006.01) |
| ***F25B 5/00*** | (2006.01) |
| ***F25B 41/39*** | (2021.01) |

(52) U.S. Cl.
CPC ..... *F25J 1/0052* (2013.01); *F25J 1/0057* (2013.01); *F25J 1/0072* (2013.01); *F25J 1/0085* (2013.01); *F25J 1/0095* (2013.01); *F25J 1/0205* (2013.01); *F25J 1/0207* (2013.01); *F25J 1/0215* (2013.01); *F25J 1/0218* (2013.01); *F25J 1/0227* (2013.01); *F25J 1/0245* (2013.01); *F25J 1/0265* (2013.01); *F25J 1/0268* (2013.01); *F25B 41/39* (2021.01); *F25B 2309/061* (2013.01); *F25B 2400/12* (2013.01); *F25B 2400/13* (2013.01); *F25J 2210/06* (2013.01); *F25J 2245/02* (2013.01); *F25J 2270/12* (2013.01); *F25J 2270/60* (2013.01); *F25J 2270/90* (2013.01); *F25J 2270/902* (2013.01); *F25J 2270/906* (2013.01)

(58) Field of Classification Search
CPC ..... F25J 1/0215; F25J 1/0218; F25J 1/0265; F25J 1/0268; F25J 2210/061; F25J 2270/902; F25J 3/061; F25B 2309/061
See application file for complete search history.

(56) References Cited

U.S. PATENT DOCUMENTS

| | | | | |
|---|---|---|---|---|
| 3,511,058 | A | 5/1970 | Becker | |
| 3,735,601 | A | 5/1973 | Stannard, Jr. | |
| 3,817,046 | A | 6/1974 | Aoki et al. | |
| 4,548,629 | A | 10/1985 | Chiu | |
| 5,537,827 | A | 7/1996 | Low et al. | |
| 5,768,912 | A | 6/1998 | Dubar | |
| 6,357,257 | B1 | 3/2002 | Goble, Jr. et al. | |
| 6,722,157 | B1 | 4/2004 | Eaton et al. | |
| 7,386,996 | B2 | 6/2008 | Fredheim et al. | |
| 8,464,551 | B2 | 6/2013 | Roberts et al. | |
| 2013/0213064 | A1 | 11/2013 | Gomes et al. | |
| 2015/0338161 | A1* | 11/2015 | Park | F25J 1/0052 62/611 |
| 2016/0123351 | A1 | 5/2016 | Nagao et al. | |

FOREIGN PATENT DOCUMENTS

| | | |
|---|---|---|
| CN | 106440656 | 2/2017 |
| DE | 102012017653 | 3/2014 |
| FR | 2957140 | 9/2014 |
| JP | S613985 | 1/1986 |
| JP | 01-222194 | 9/1989 |
| JP | 09-194862 | 7/1997 |
| JP | 2008-536078 | 9/2008 |
| JP | 2009257706 | 11/2009 |
| JP | 2010-50///1 | 3/2010 |
| JP | 2010-516994 | 5/2010 |
| JP | 2015210079 | 11/2015 |
| JP | 2017-067432 | 4/2017 |
| JP | 2017-187274 | 12/2017 |
| KR | 20050110029 | 11/2005 |
| KR | 20110062441 | 6/2011 |
| RU | 2073181 | 2/1997 |
| WO | 2009153427 | 12/2009 |
| WO | 2017061233 | 4/2017 |

OTHER PUBLICATIONS

Zongming Yuan, et al, "Design and analysis of a small-scale natural gas liquefaction process adopting single nitrogen expansion with carbon dioxide pre-cooling", Elsevier Ltd., Sep. 29, 2013.
Justin D. Bukowski, "Natural Gas Liquefaction Technology for Floating LNG Facilities", 2013, pp. 1-12, Allentown, PA.
Maya Kusmaya, "Liquefaction Process Evaluation for Floating LNG", Jun. 4, 2014, pp. 1-50, Trondheim, Norway.

* cited by examiner

METHOD AND SYSTEM FOR COOLING A HYDROCARBON STREAM

BACKGROUND

Liquefaction systems for cooling, liquefying, and optionally subcooling natural gas are well known in the art, such as the single mixed refrigerant (SMR) cycle, the propane pre-cooled mixed refrigerant (C3MR) cycle, the dual mixed refrigerant (DMR) cycle, C3MR-Nitrogen hybrid (such as AP-X™) cycles, the gas phase expansion process (such as nitrogen or methane expander cycle), and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Some examples of pure component two-phase refrigerants are propane, carbon dioxide, hydrofluorocarbons (HFC), ethane, ethylene, and others. Some of these are especially suitable for precooling service.

Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Boiling heat transfer is a commonly used heat transfer mode, wherein the refrigerant boils at one or more pressure levels to provide the cooling duty required. Critical point is the point on a pressure-enthalpy (P-H) diagram at which the saturated liquid and saturated vapor lines of the fluid meet. Critical temperature is a thermodynamic property of a fluid and is the temperature at the critical point. There are two types of refrigerant operation—subcritical operation, wherein all steps in the process take place always below the critical point, and transcritical operation, wherein at least one step in the process occurs above the critical point while at least one step in the process occurs below the critical point.

FIG. 1A shows a P-H diagram for subcritical operation for a single pressure cooling process. The refrigerant vapor (A) is at a pressure of P1 and temperature of T1 and is compressed to pressure P2 and temperature T2 (B). The compressed vapor is then de-superheated to the dew point (C), condensed to the bubble point (D), and subcooled to produced subcooled liquid (E). The temperature at E is the aftercooler outlet temperature, also referred to as $T_{AC}$ and shown with an isotherm in FIG. 1A. The subcooled liquid is then let down in pressure to the original pressure P1 (F). The liquid component of the refrigerant at point F is vaporized to complete the cycle and return to vapor phase (A). During step B-E, the process rejects heat to ambient air or cooling water and during step F-A, the process provides cooling duty to a process stream, such as the natural gas feed stream and/or another refrigerant.

FIG. 1B shows the P-H diagram for transcritical operation for a single pressure cooling process. The cycle diagram is like that in FIG. 1A, however, the heat rejection step B-E occurs above the critical point. The critical temperature, $T_{CRIT}$, is shown with an isotherm. The process starts with refrigerant vapor (A) at pressure P1 and temperature T1 below the critical temperature. It is then compressed to pressure P2 and temperature T2 (B), which is above the critical temperature. Above the critical point, a fluid does not possess distinct vapor and liquid phases. Therefore, when it is cooled from point B to point E, it does not condense. The fluid exhibits vapor-like properties at point B and liquid-like properties at point E. However, unlike the subcritical condensing process, where temperature stays constant during the condensation process (C-D), the temperature reduces continually during the transcritical heat rejection step. The heat rejection step for transcritical processes may have lower efficiency than that for subcritical processes, which is a drawback of transcritical processes.

The temperature at E after heat rejection, for both subcritical and transcritical operation, is set by the ambient temperature plus a heat exchanger approach temperature. Due to the vertical nature of the isotherms (constant temperature lines) above the critical point, E is in the central portion of the graph, for transcritical operation. Therefore, when refrigerant is letdown in pressure from E to F, a two-phase stream with large amounts of vapor is produced. Therefore, the refrigerant at F has a higher vapor fraction in a transcritical process than in a subcritical process. It is the liquid component of the refrigerant at F that vaporizes to provide the cooling duty required. Therefore, due to the high vapor fraction at F, transcritical processes inherently have lower process efficiency than subcritical processes.

The temperature at E, which is the ambient cooler outlet temperature, is given by the ambient temperature plus any approach to ambient, and is a critical factor in determining whether subcritical or transcritical operation takes place. If the ambient cooler outlet temperature is lower than the critical temperature, as in FIG. 1A, subcritical operation takes place. If the ambient cooler outlet temperature is greater than or equal to the critical temperature, as in FIG. 1B, transcritical operation takes place.

Refrigerants such as propane and mixed refrigerant have critical temperatures that are well above typical ambient cooler outlet temperatures, even for hot ambient conditions, and therefore have subcritical operation. Carbon dioxide and ethane have critical temperatures of about 31 degrees Celsius. Ethylene has a critical temperature of about 10 degrees Celsius. Depending on the ambient temperature, carbon dioxide, ethane, and ethylene, will have transcritical operation for typical hot and average ambient conditions, and will therefore have low process efficiency. This is a significant drawback of transcritical operation.

Another problem with transcritical operation is refrigerant inventory management with ambient temperature swings. For transcritical operation, the heat rejection step B-E takes place above the critical point and there is no condensation. As the refrigerant cools, its temperature continually reduces and its density increases. The refrigerant at E has liquid-like density but it is not a liquid. Accordingly, inventory management procedures are preferably based on pressure, in a manner similar to how a vapor-phase refrigerant inventory would be managed. As the ambient temperature reduces, the ambient cooler outlet temperature is now lower than the critical temperature and the operation switches to subcritical. The refrigerant is fully condensed and subcooled at E. Therefore, inventory management procedures would preferably be based on those for a liquid refrigerant, using liquid level control. In other words, as operation switches from transcritical to subcritical with ambient temperature swings, inventory management methods may need to change as well. This is an operational challenge associated with transcritical refrigerants.

Carbon dioxide, for example, is non-flammable and has benefits in floating LNG (FLNG) applications. It has a high density, which enables a low volumetric flowrate of refrigerant, as well as low piping sizes. However, due to the problems stated herein for transcritical operation, it has not been preferred for natural gas liquefaction applications.

Therefore, there is an unmet need for an efficient method and system for solving the problems associated with transcritical operation and enabling the use of transcritical refrigerants for LNG service.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments, as described below and as defined by the claims which follow, comprise improvements to cooling and liquefaction systems used as part of an LNG liquefaction processes. Some embodiments satisfy the need in the art by using a hybrid cooling process, thereby enabling the use of otherwise transcritical refrigerants for LNG service.

In addition, several specific aspects of the systems and methods are outlined below.

Aspect 1: A method for cooling a hydrocarbon feed stream against a first refrigerant to produce a cooled hydrocarbon stream, the first refrigerant having a critical temperature, the method comprising:

(a) compressing the first refrigerant in at least one compression stage to produce a compressed first refrigerant;

(b) cooling the compressed first refrigerant against an ambient fluid in at least one heat exchanger to produce a cooled first refrigerant having a first temperature that is greater than or equal to the critical temperature of the first refrigerant;

(c) further cooling the cooled first refrigerant in at least one economizer heat exchanger against at least a first portion of the cooled first refrigerant to produce a further cooled first refrigerant at a second temperature and a warmed first refrigerant, the second temperature being less than the critical temperature of the first refrigerant; and (d) cooling a fluid stream in each of at least one cooling circuit located in downstream fluid flow communication from the economizer, each of the at least one cooling circuit having at least one evaporation stage, each of the following steps being performed in each evaporation stage:

(i) reducing the pressure of the first refrigerant;

(ii) cooling the fluid stream against the reduced pressure first refrigerant in an evaporator, resulting in vaporization of at least a portion of the reduced pressure first refrigerant; and (iii) flowing at least a portion of the vaporized reduced pressure first refrigerant into one of the at least one compression stages;

wherein at least one fluid stream being cooled in the at least one cooling circuit comprises the hydrocarbon feed stream and step (d) produces a cooled hydrocarbon stream.

Aspect 2: The method of claim 1, further comprising:

(e) further cooling and liquefying the cooled hydrocarbon stream in at least one liquefaction heat exchanger against a second refrigerant stream to produce a liquefied natural gas stream.

Aspect 3: The method of Aspect 2, wherein at least one fluid stream being cooled in the at least one cooling circuit comprises the second refrigerant.

Aspect 4: The method of any of Aspects 1-3, wherein the first refrigerant comprises ethane, carbon-dioxide, or ethylene.

Aspect 5: The method of any of Aspects 1-4, wherein step (a) further comprises:

(a) compressing the first refrigerant in a plurality of compression stages to produce a compressed first refrigerant.

Aspect 6: The method of any of Aspects 1-5, wherein step (d) further comprises cooling at least one fluid stream in a plurality of evaporation stages located downstream from the economizer, wherein the steps (d)(i) through (d)(iii) are performed in each of the plurality of evaporation stages.

Aspect 7: The method of any of Aspects 1-6, further comprising:

(f) combining a vapor phase portion of the warmed first refrigerant with the vaporized reduced pressure first refrigerant in one of the at least one evaporation stage before performing step (d)(iii).

Aspect 8: The method of Aspect 7, further comprising:

(g) separating the warmed first refrigerant into the vapor phase portion and a liquid phase portion and performing step (d) using the liquid phase portion.

Aspect 9: An apparatus for cooling a hydrocarbon feed stream, the apparatus comprising:

at least one compression stage operationally configured to compress a first refrigerant;

at least one ambient heat exchanger in downstream fluid flow communication with the at least one compression stage, the at least one ambient heat exchanger being operationally configured to cool the first refrigerant to a first temperature by indirect heat exchange against an ambient fluid, the first temperature being greater than or equal to the critical temperature of the first refrigerant;

at least one economizer in downstream fluid flow communication with the at least one ambient heat exchanger, the economizer being operationally configured to further cool the first refrigerant to a second temperature that is below the critical temperature of the first refrigerant;

at least one cooling circuit located in downstream fluid flow communication from the at least one economizer, each of the at least one cooling circuit having at least one evaporation stage, each of the evaporation stages comprising an expansion valve in upstream fluid flow communication with an evaporator, the evaporator operationally configured to cool a fluid stream against the first refrigerant and to create a vaporized first refrigerant stream and a cooled fluid stream, each of the evaporation stages further comprising a vaporized first refrigerant circuit in fluid flow communication with one of the at least one compression stages;

wherein the fluid stream of at least one of the at least one cooling circuit comprises the hydrocarbon feed stream.

Aspect 10: The apparatus of Aspect 9, further comprising a liquefaction heat exchanger operationally configured to further cool and liquefy the hydrocarbon stream in at least one liquefaction heat exchanger against a second refrigerant stream to produce a liquefied natural gas stream.

Aspect 11: The apparatus of Aspect 10, wherein the fluid stream of at least one of the at least one cooling circuit comprises the second refrigerant.

Aspect 12: The apparatus of any of Aspects 9-11, wherein the first refrigerant comprises ethane, carbon-dioxide, or ethylene.

Aspect 13: The apparatus of any of Aspects 9-12, wherein the at least one compression stage comprises a plurality of compression stages.

Aspect 14: The apparatus of Aspect 13, wherein the at least one evaporator stage comprises a plurality of evaporator stages.

Aspect 15: A method for cooling a hydrocarbon feed stream against a first refrigerant to produce a cooled hydrocarbon stream, the first refrigerant having a critical temperature, the method comprising:

(a) compressing the first refrigerant in at least one compression stage to produce a compressed first refrigerant;

(b) cooling the compressed first refrigerant against an ambient fluid in at least one heat exchanger to produce a cooled first refrigerant having a first temperature that is greater than or equal to the critical temperature of the first refrigerant;

(c) further cooling the cooled first refrigerant in at least one auxiliary heat exchanger to produce a further cooled first refrigerant at a second temperature that is less than the critical temperature of the first refrigerant; and (d) cooling a fluid stream in each of at least one cooling circuit located in downstream fluid flow communication from the auxiliary heat exchanger, each of the at least one cooling circuit having at least one evaporation stage, each of the following steps being performed in each evaporation stage:

(i) reducing the pressure of the first refrigerant;

(ii) cooling the fluid stream against the reduced pressure first refrigerant in an evaporator, resulting in vaporization of at least a portion of the reduced pressure first refrigerant; and (iii) flowing at least a portion of the vaporized reduced pressure first refrigerant into one of the at least one compression stages;

wherein at least one fluid stream being cooled in the at least one cooling circuit comprises the hydrocarbon feed stream and step (d) produces a cooled hydrocarbon stream; and wherein refrigeration duty for the at least one auxiliary heat exchanger is provided by at least one auxiliary refrigerant selected from the group of: (1) the hydrocarbon feed stream and (2) a third refrigerant that is cooled by a vapor expansion or vapor compression cycle.

Aspect 16: The method of Aspect 15, further comprising:

(e) further cooling and liquefying the cooled hydrocarbon stream in at least one liquefaction heat exchanger against a second refrigerant stream to produce a liquefied natural gas stream.

Aspect 17: The method of Aspect 16, wherein at least one fluid stream being cooled in the at least one cooling circuit comprises the second refrigerant.

Aspect 18: The method of Aspect 17, wherein the second refrigerant is in vapor phase in step (d)(ii) and the third refrigerant is a portion of the second refrigerant.

Aspect 19: The method of any of Aspects 15-18, wherein the first refrigerant comprises ethane, carbon-dioxide, or ethylene.

Aspect 20: The method of any of Aspects 15-19, wherein step (a) further comprises:

(a) compressing the first refrigerant in a plurality of compression stages to produce a compressed first refrigerant.

Aspect 21: The method of Aspect 20, wherein step (d) further comprises cooling at least one fluid stream in a plurality of evaporation stages located downstream from the auxiliary heat exchanger, wherein the steps (d)(i) through (d)(iii) are performed in each of the plurality of evaporation stages.

Aspect 22: The method of any of Aspects 15-21, further comprising:

(e) combining a vapor phase portion of the warmed first refrigerant with the vaporized reduced pressure first refrigerant in one of the at least one evaporation stage before performing step (d)(iii).

Aspect 23: The method of Aspect 22, further comprising:

(f) separating the warmed first refrigerant into the vapor phase portion and a liquid phase portion and performing step (d) using the liquid phase portion.

DETAILED DESCRIPTION

Figure 1A:
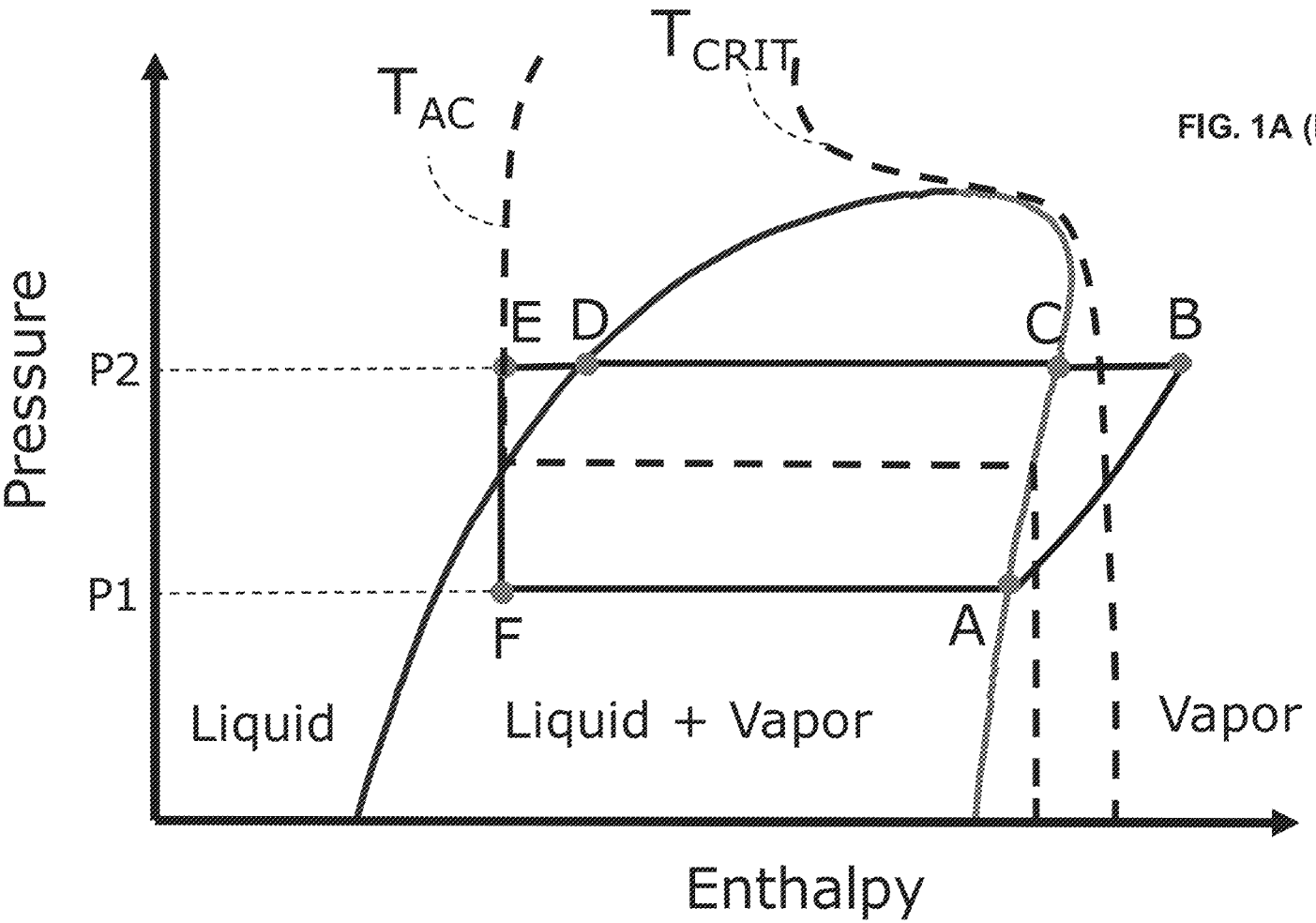
FIG. 1A (Prior Art)
FIG. 1A is a pressure versus enthalpy (P-H) diagram for a subcritical cooling process in accordance with the prior art.

The ensuing detailed description provides preferred exemplary embodiments only, and is not intended to limit the scope, applicability, or configuration. Rather, the ensuing detailed description of the preferred exemplary embodiments will provide those skilled in the art with an enabling description for implementing the preferred exemplary embodiments. Various changes may be made in the function and arrangement of elements without departing from their spirit and scope.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the disclosed embodiments (e.g., upper, lower, left, right, etc.). These directional terms are merely intended to assist in describing exemplary embodiments, and are not intended to limit the scope of the claims. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits include, but are not limited to, pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and, more preferably, at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compressor stage and ending downstream from the last compressor or compressor stage. The term "compression sequence" is intended to refer to the steps performed by the components and conduits that comprise the associated compression circuit.

As used in the specification and claims, the terms "high-high", "high", "medium", "low", and "low-low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

As used herein, the term "compressor" in intended to mean a device having at least one compressor stage contained within a casing and that increases the pressure of a fluid stream.

As used herein, the term "critical point" of a fluid is the point on the fluid's P-H diagram where the saturated liquid and saturated vapor lines meet.

As used herein, the term "subcritical" is intended to refer to a process that occurs below the critical point of the refrigerant.

As used herein, the term "transcritical" is intended to refer to a process comprising one or more steps that occur below the critical point of the refrigerant and one or more steps that occur above the critical point of the refrigerant.

As used herein, the term "isotherm" is intended to refer to a constant temperature line.

As used herein, the term "vapor compression cycle" is intended to refer to a refrigeration cycle in which the refrigerant undergoes phase change during the refrigeration cycle. For instance, a vapor refrigerant is compressed, cooled and at least partially condensed, then reduced in pressure, and at least partially vaporized to provide refrigeration duty.

As used herein, the term "vapor expansion cycle" is intended to refer to a refrigeration cycle in which the refrigerant is in the vapor phase and does not undergo phase change during the cycle. For instance, a vapor refrigerant is compressed, cooled without phase change, then reduced in pressure and warmed to provide refrigerant duty.

As used herein, the term "closed loop vapor compression cycle" is intended to refer to a vapor compression cycle in which no refrigerant is added or removed from the cycle (with the possible exception of leakage and refrigerant make-up) during steady-state operation. In all the embodiments disclosed herein, the precooling refrigeration cycle is a closed loop vapor compression cycle.

As used herein, the term "economizer" as used herein, is intended to mean a heat exchanger that is operationally configured to provide an indirect heat exchange between a fluid stream and at least a portion of the same at a different temperature.

Table 1 defines a list of acronyms employed throughout the specification and drawings as an aid to understanding the described embodiments.

TABLE 1

| | | | |
|---|---|---|---|
| SMR | Single Mixed Refrigerant | MCHE | Main Cryogenic Heat Exchanger |
| DMR | Dual Mixed Refrigerant | MR | Mixed Refrigerant |
| C3MR | Propane-precooled Mixed Refrigerant | MRL | Mixed Refrigerant Liquid |
| LNG | Liquid Natural Gas | MRV | Mixed Refrigerant Vapor |
| LLP | Low-Low Pressure | HHP | High-High Pressure |
| LP | Low Pressure | MP | Medium Pressure |
| HP | High Pressure | MTPA | Million Metric Tonnes Per Annum |
| HFC | Hydrofluorocarbon | LIN | Liquid Nitrogen |
| CO2 | Carbon dioxide | LiBr | Lithium Bromide |

The described embodiments provide an efficient process for the liquefaction of a hydrocarbon fluid and are particularly applicable to the liquefaction of natural gas.

Figure 2:
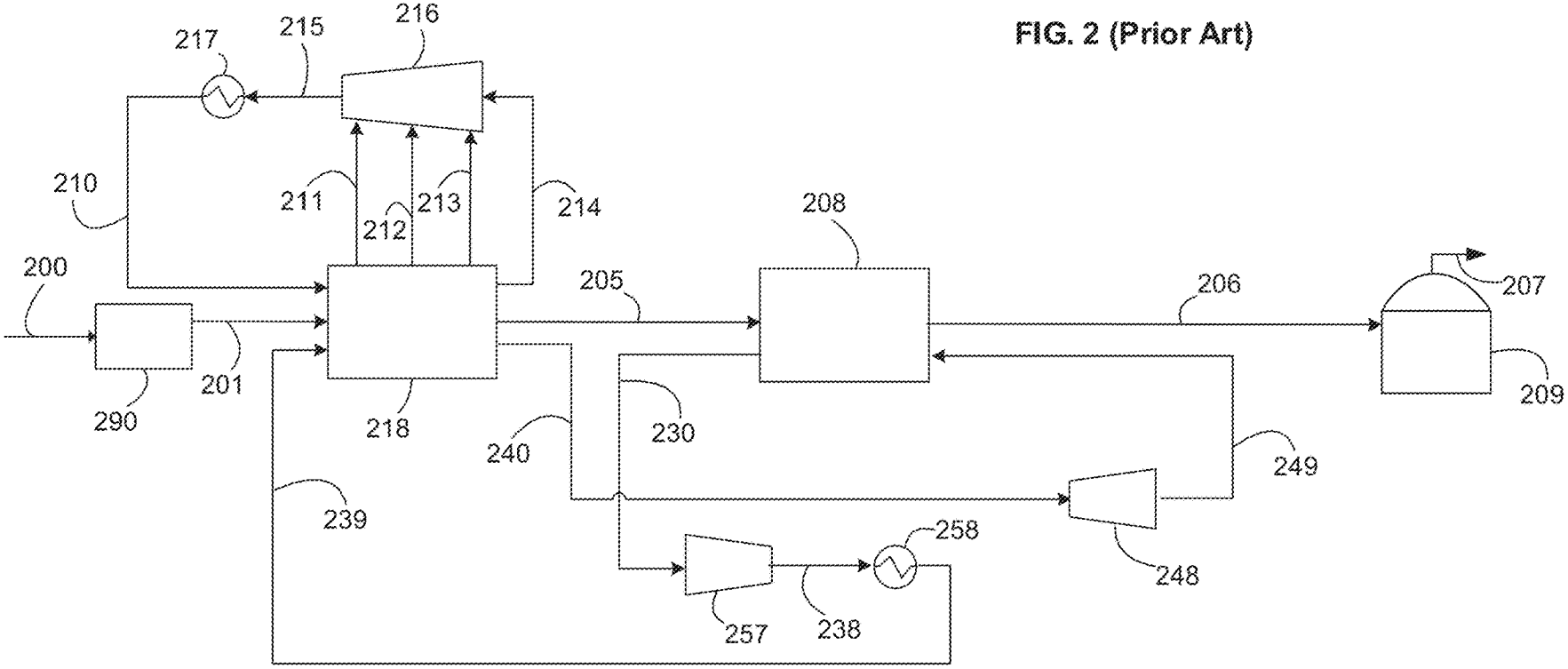
FIG. 2 (Prior Art)
FIG. 2 is a schematic flow diagram of a precooled-gas phase expansion system in accordance with the prior art.

Referring to FIG. 2, a typical precooled-gas phase expansion process of the prior art is shown. In this arrangement, the precooling duty is provided by boiling heat transfer using a two-phase refrigerant and the liquefaction and subcooling duty is provided by sensible heat transfer using a gas phase refrigerant. Some examples of the gas refrigerant include nitrogen, methane, and combinations thereof.

A feed stream 200, which is preferably natural gas, is cleaned and dried by known methods in a pre-treatment section 290 to remove water, acid gases such as $CO_2$ and $H_2S$, and other contaminants such as mercury, resulting in a pre-treated feed stream 201. The pre-treated feed stream 201, which is essentially water free, is pre-cooled in a precooling system 218 to produce a pre-cooled natural gas stream 205 and further cooled, liquefied, and/or sub-cooled in a main cryogenic heat exchanger (MCHE) 208 (also referred to as a main heat exchanger) to produce LNG stream 206. The LNG stream 206 is preferably let down in pressure by passing it through a valve or a turbine (not shown) and is then sent to LNG storage tank 209. Any flash vapor produced during the pressure letdown and/or boil-off in the tank is represented by stream 207, which may be used as fuel in the plant, recycled to feed, or vented.

The term "essentially water free" means that any residual water in the pre-treated feed stream 201 is present at a sufficiently low concentration to prevent operational issues associated with water freeze-out in the downstream cooling and liquefaction process. In the embodiments described herein, water concentration is preferably not more than 1.0 ppm and, more preferably between 0.1 ppm and 0.5 ppm.

The pre-treated feed stream 201 is pre-cooled to a temperature preferably below 10 degrees Celsius, more preferably below about 0 degrees Celsius, and most preferably about −30 degrees Celsius. The pre-cooled natural gas stream 205 is liquefied to a temperature preferably between about −150 degrees Celsius and about −70 degrees Celsius, more preferably between about −145 degrees Celsius and about −100 degrees Celsius, and subsequently sub-cooled to a temperature preferably between about −170 degrees Celsius and about −120 degrees Celsius, more preferably between about −170 degrees Celsius and about −140 degrees Celsius. MCHE 208 may be any type of heat exchanger such as a coil wound heat exchanger with one or more bundles, a plate and fin heat exchanger, a core-in-kettle heat exchanger, a shell and tube heat exchanger, and any other type of heat exchanger suitable for the liquefaction of subcooling of natural gas. Further, one or more heat exchangers in series of parallel may be used. In some cases, an economizer heat exchanger may also be used.

As illustrated in FIG. 2, a cooled precooling refrigerant 210 is warmed against at least the pre-treated feed stream 201 to produce a warm low pressure precooling refrigerant 214. The warm low pressure precooling refrigerant 214 is compressed in one or more precooling refrigerant compressor(s) 216 that may comprise four compressor stages 216A, 216B, 216C, 216D. Three side streams 211, 212, and 213 at intermediate pressure levels enter the precooling refrigerant compressor 216 at the suction of the final 216D, third 216C, and second 216B stages of the precooling refrigerant compressor 216 respectively. The compressed precooling refrigerant 215 is cooled in one or more heat exchangers, such as desuperheater, condenser, and/or subcooler heat exchangers, depicted as precooling refrigerant condenser 217, to produce the cooled precooling refrigerant 210 that provides the precooling duty required.

The precooling refrigerant condenser 217 preferably exchanges heat against an ambient fluid such as air or water. Although FIG. 2 shows four stages of precooling refrigerant compression, any number of compressor stages may be employed. It should be understood that when multiple compressor stages are described or claimed, such multiple compressor stages could comprise a single multi-stage compressor, multiple compressors, or a combination thereof. The compressors could be in a single casing or multiple casings. The process of compressing the precooling refrigerant is generally referred to herein as the precooling compression sequence, and is described in detail in FIG. 4. Some examples of the precooling refrigerant include propane, MR, carbon dioxide, HFC, ethane, ethylene, and others.

A warm liquefaction refrigerant 230 is withdrawn from MCHE 208 and compressed in a high pressure (HP) compressor 257 to produce a compressed liquefaction refrigerant 238. One or more refrigerant compressors, compression stages may be used with optional inter-cooling. The compressed liquefaction refrigerant 238 is cooled against ambient air or water in a high pressure aftercooler 258 to produce a cooled liquefaction refrigerant 239 in gas phase. One or more heat exchangers may be used. The high pressure aftercooler 258 may be of any type, such as a plate and fin or shell and tube heat exchanger. The cooled liquefaction refrigerant 239 is precooled against the precooling refrigerant in the precooling system 218 to produce a precooled liquefaction refrigerant 240. The precooled liquefaction refrigerant 240 may be expanded in one or more gas phase expanders 248 to produce an expanded gas phase refrigerant 249, which is sent to the MCHE 208 to provide the liquefaction and subcooling duty required.

The liquefaction and subcooling system of FIG. 2 may use nitrogen, methane, or a combination thereof. It could use feed gas or flash gas from the process, in an open or closed loop system. It may also comprise one or more cooling systems in series or parallel using independent gas phase refrigerant systems. Further, it could employ one or more gas phase expanders, compressor-expander assemblies (companders), economizer heat exchangers, and other variations.

Figure 3:
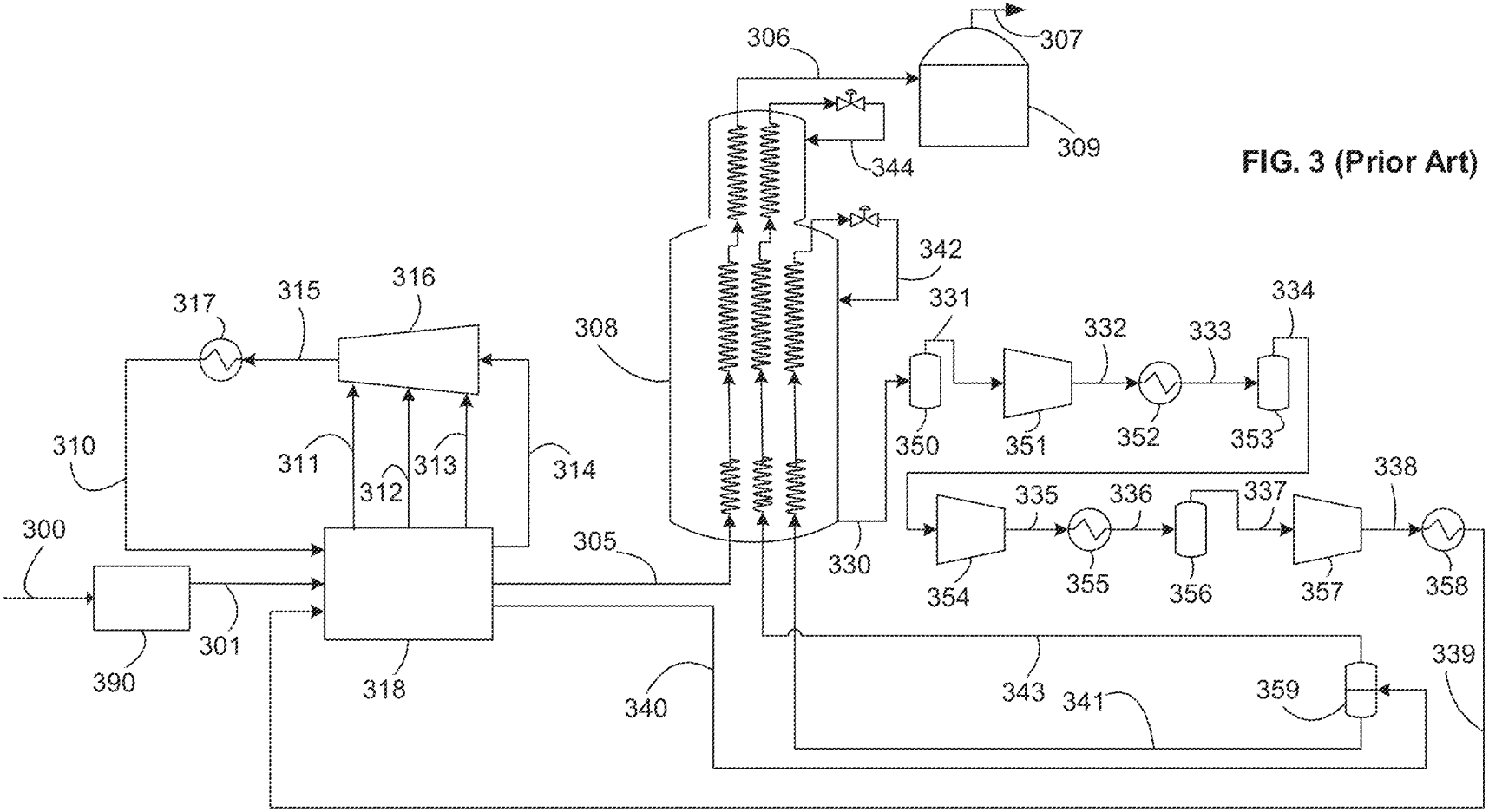
FIG. 3 (Prior Art)
FIG. 3 is a schematic flow diagram of a precooled-MR system in accordance with the prior art.

Referring to FIG. 3, a typical precooled-MR process of the prior art is shown. A feed stream 300, which is preferably natural gas, is cleaned and dried by known methods in a pre-treatment section 390 to remove water, acid gases such as $CO_2$ and $H_2S$, and other contaminants such as mercury, resulting in a pre-treated feed stream 301. The pre-treated feed stream 301, which is essentially water free, is pre-cooled in a precooling system 318 to produce a pre-cooled natural gas stream 305 and further cooled, liquefied, and/or sub-cooled in a main cryogenic heat exchanger (MCHE) 308 (also referred to as a main heat exchanger) to produce LNG stream 306. The LNG stream 306 is preferably let down in pressure by passing it through a valve or a turbine (not shown) and is then sent to LNG storage tank 309. Any flash vapor produced during the pressure letdown and/or boil-off in the tank is represented by stream 307, which may be used as fuel in the plant, recycled to feed, or vented.

The pre-treated feed stream 301 is pre-cooled to a temperature preferably below 10 degrees Celsius, more preferably below about 0 degrees Celsius, and most preferably about −30 degrees Celsius. The pre-cooled natural gas stream 305 is liquefied to a temperature preferably between about −150 degrees Celsius and about −70 degrees Celsius, more preferably between about −145 degrees Celsius and about −100 degrees Celsius, and subsequently sub-cooled to a temperature preferably between about −170 degrees Celsius and about −120 degrees Celsius, more preferably between about −170 degrees Celsius and about −140 degrees Celsius. MCHE 308 shown in FIG. 3 is a coil wound heat exchanger with three bundles. However, any number of bundles and any exchanger type(s) may be utilized.

The term "essentially water free" means that any residual water in the pre-treated feed stream 301 is present at a sufficiently low concentration to prevent operational issues associated with water freeze-out in the downstream cooling and liquefaction process. In the embodiments described in herein, water concentration is preferably not more than 1.0 ppm and, more preferably between 0.1 ppm and 0.5 ppm.

As illustrated in FIG. 3, a cooled precooling refrigerant 310 is warmed against at least the pre-treated feed stream 301 to produce a warm low pressure precooling refrigerant 314. The warm low pressure precooling refrigerant 314 is compressed in one or more precooling refrigerant compressor(s) 316 that may comprise four compressor stages 316A, 316B, 316C, 316D. Three side streams 311, 312, and 313 at intermediate pressure levels enter the precooling refrigerant compressor 316 at the suction of the final 316D, third 316C, and second 316B stages of the precooling refrigerant compressor 316 respectively. The compressed precooling refrigerant 315 is cooled in one or more heat exchangers, shown on FIG. 3 with precooling refrigerant condenser 317, to produce the cooled precooling refrigerant 310 that provides the cooling duty required.

The precooling refrigerant liquid evaporates to produce the warm low pressure precooling refrigerant 314. The precooling refrigerant condenser 317 preferably exchanges heat against an ambient fluid including, but not limited to, air or water. Although the figure shows four stages of precooling refrigerant compression, any number of compressor stages may be employed. It should be understood that when multiple compressor stages are described or claimed, such multiple compressor stages could comprise a single multi-stage compressor, multiple compressors, or a combination thereof. The compressors could be in a single casing or multiple casings. The process of compressing the precooling refrigerant is generally referred to herein as the precooling compression sequence, and is described in detail in FIG. 4.

A warm liquefaction refrigerant 330 is withdrawn from the MCHE 308 and in case of a coil wound heat exchanger, it would be withdrawn from the bottom of the shell side of the MCHE 308. The warm liquefaction refrigerant 330 is sent through a low pressure suction drum 350 to separate out any liquids and the vapor stream 331 is compressed in a low pressure (LP) compressor 351 to produce medium pressure MR stream 332. The warm liquefaction refrigerant 330 is preferably withdrawn at a temperature at or near precooling refrigerant precooling temperature and more preferably about −30 degree Celsius and at a pressure of less than 10 bar (145 psia). The medium pressure MR stream 332 is cooled in a low pressure aftercooler 352 to produce a cooled medium pressure MR stream 333 from which any liquids are drained in medium pressure suction drum 353 to produce medium pressure vapor stream 334 that is further compressed in medium pressure (MP) compressor 354. The resulting high pressure MR stream 335 is cooled in a medium pressure aftercooler 355 to produce a cooled high pressure MR stream 336. The cooled high pressure MR stream 336 is sent to a high pressure suction drum 356 where any liquids are drained. The resulting high pressure vapor stream 337 is further compressed in a high pressure (HP) compressor 357 to produce compressed liquefaction refrigerant 338 that is cooled in high pressure aftercooler 358 to produce a cooled high-high pressure (HHP) MR stream 339. The cooled HHP MR stream 339 is then cooled against evaporating precooling refrigerant in precooling system 318 to produce a precooled liquefaction refrigerant 340 that is then sent to a vapor-liquid separator 359 from which an MRL stream 341 and a MRV stream 343 are obtained, which are sent back to MCHE 308 to be further cooled. Liquid streams leaving phase separators are referred to in the industry as MRL and vapor streams leaving phase separators are referred to in the industry as MRV, even after they are subsequently liquefied. The process of compressing and cooling the MR after it is withdrawn from the bottom of the MCHE 308, then returned to the tube side of the MCHE 308 as multiple streams, is generally referred to herein as the MR compression sequence.

Both the MRL stream 341 and MRV stream 343 are cooled, in two separate circuits of the MCHE 308. The MRL stream 341 is cooled in the first two bundles of the MCHE 308, resulting in a cold stream that is let down in pressure to produce a cold MRL stream 342 that is sent back to the shell-side of MCHE 308 to provide refrigeration required in the first two bundles of the MCHE. The MRV stream 343 is cooled in the first, second, and third bundles of MCHE 308, reduced in pressure across a cold high pressure letdown valve, and introduced to the MCHE 308 as cold MRV stream 344 to provide refrigeration in the subcooling, liquefaction, and cooling steps. MCHE 308 can be any exchanger suitable for natural gas liquefaction including, but not limited to, a coil wound heat exchanger, a plate and fin heat exchanger or a shell and tube heat exchanger. Coil wound heat exchangers are the state of the art exchangers for natural gas liquefaction and include at least one tube bundle comprising a plurality of spiral wound tubes for flowing process and warm refrigerants and a shell space for flowing a cold refrigerant.

Figure 4:
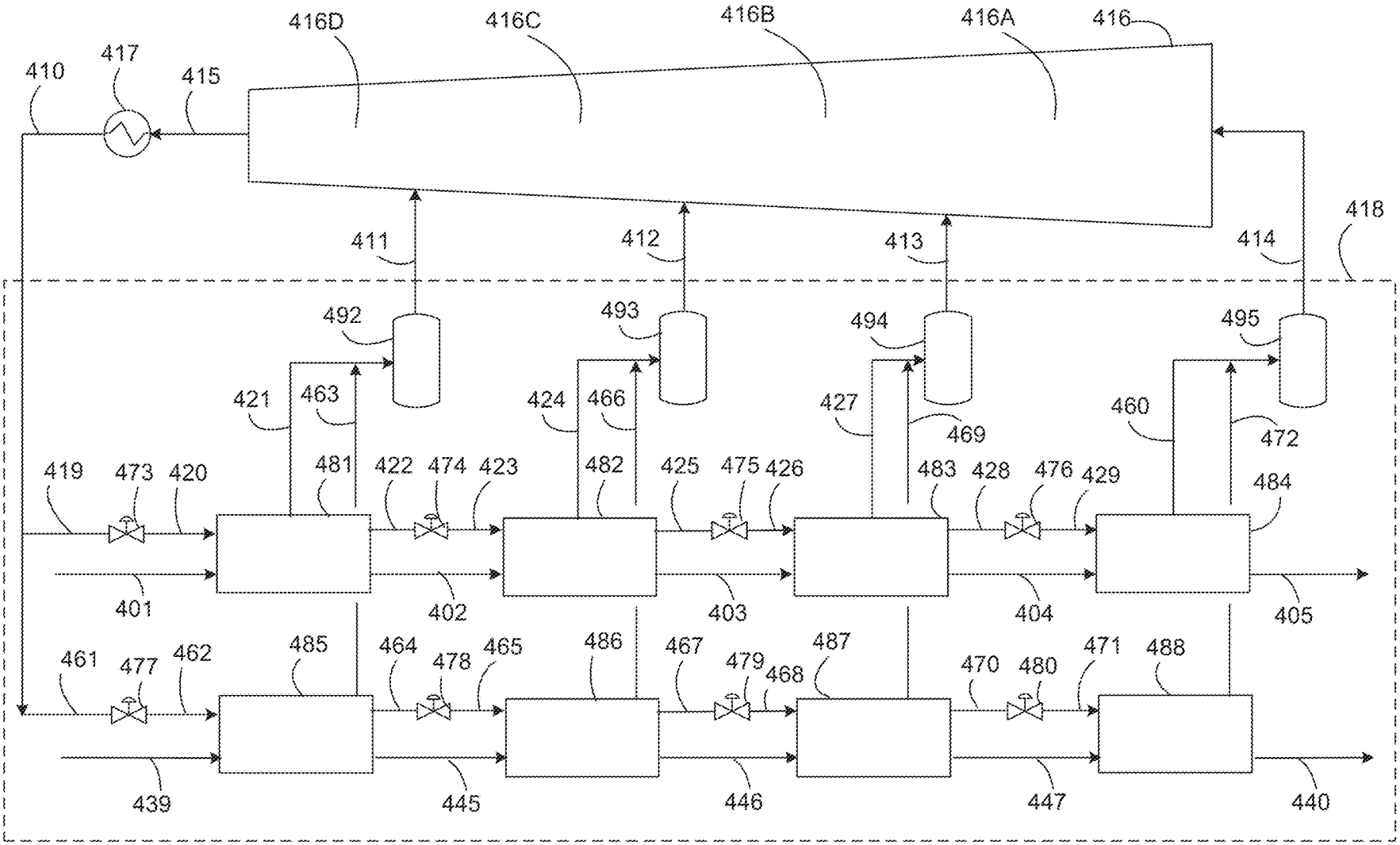
FIG. 4 (Prior Art)
FIG. 4 is a schematic flow diagram of a cooling system in accordance with the prior art.

FIG. 4 illustrates an exemplary arrangement of the precooling system 418 and the precooling compression sequence depicted in FIGS. 2 and 3. The following arrangement shows a four pressure level precooling system, however, any number of pressure levels may be utilized. The pre-treated feed stream 401, is cooled by indirect heat exchange in HP feed evaporator 481 to produce a first intermediate feed stream 402, which is then cooled in a MP feed evaporator 482 to produce a second intermediate feed stream 403, followed by a LP feed evaporator 483 to produce a third intermediate feed stream 404, and finally a low-low pressure (LLP) feed evaporator 484 to produce the pre-cooled natural gas stream 405.

Each pressure level is also referred to herein as an evaporation stage. Using the highest pressure evaporation stage of the cooling circuit for the pre-treated feed stream 401 as an example, each evaporation stage includes a pressure letdown valve 473, an evaporator 481, an outlet conduit for vaporized precooling refrigerant 421, and a separator 492 (which may be shared with a corresponding evaporator 485 in another cooling circuit). The pressure letdown valve 473 is located upstream from the evaporator 481, on a conduit through which the precooling refrigerant 420 flows. Each evaporation stage provides a reduction in pressure for the pre-cooling refrigerant, heat transfer between the precooling refrigerant and the stream being cooled, and conduits to allow a vaporized portion of the precooling refrigerant to flow to the compressor 416 and (in all but the last evaporation stage) a liquid portion of the precooling refrigerant to flow to the next evaporation stage. Each cooling circuit comprises all of the evaporation stages that provide cooling for each fluid stream being cooled by the precooling refrigerant—in this embodiment, the pre-treated feed stream 401 and the cooled liquefaction refrigerant stream 439. For example, the four evaporation stages associated with feed evaporators 481-484 form a feed cooling circuit.

The cooled liquefaction refrigerant stream 439 is further cooled by indirect heat exchange in an HP liquefaction refrigerant evaporator 485 to produce a first intermediate liquefaction refrigerant 445, which is then cooled in an MP liquefaction refrigerant evaporator 486 to produce a second intermediate liquefaction refrigerant 446, followed by an LP liquefaction refrigerant evaporator 487 to produce a third intermediate liquefaction refrigerant 447, and finally an LLP liquefaction refrigerant evaporator 488 to produce the pre-cooled liquefaction refrigerant 440. The four evaporation stages associated with liquefaction refrigerant evaporators 485-488 form a liquefaction refrigerant circuit.

Warm low pressure precooling refrigerant 414 is compressed in precooling refrigerant compressor 416 to produce compressed precooling refrigerant 415. The precooling refrigerant compressor 416 is shown as a four stage compressor with an LLP compression stage 416A, an LP compression stage 416B, an MP compression stage 416C, and an HP compression stage 416D. An LP side stream 413, MP side stream 412, and HP side stream 411 are introduced to the precooling refrigerant compressor 416 at intermediate locations.

The compressed precooling refrigerant 415 is preferably cooled by indirect heat exchange against ambient air or water in one or more heat exchangers, depicted by precooling refrigerant condenser 417 to produce the cooled precooling refrigerant 410. The cooled precooling refrigerant 410 is then preferably divided into two portions, a first portion 419 to provide cooling duty to the pre-treated feed stream 401, and a second portion 461 to provide cooling duty to the cooled liquefaction refrigerant stream 439.

The first portion 419 of the cooled precooling refrigerant may be let down in pressure in a first pressure letdown valve 473 to produce a first HP precooling refrigerant 420. The liquid fraction of the first HP precooling refrigerant 420 is partially vaporized in the HP feed evaporator 481 to produce a first HP vapor precooling refrigerant 421 and a first HP liquid precooling refrigerant 422. The first HP vapor precooling refrigerant 421 is sent to an HP precooling refrigerant separator 492, and subsequently to the suction of the HP compression stage 416D as a part of the HP side stream 411.

The first HP liquid precooling refrigerant 422 is let down in pressure in a second pressure letdown valve 474 to produce a first MP precooling refrigerant 423. The liquid fraction of the first MP precooling refrigerant 423 is partially vaporized in the MP feed evaporator 482 to produce a first MP vapor precooling refrigerant 424 and a first MP liquid precooling refrigerant 425. The first MP vapor precooling refrigerant 424 is sent to an MP precooling refrigerant separator 493, and subsequently to the suction of the MP compression stage 416C as a part of the MP side stream 412.

The first MP liquid precooling refrigerant 425 is let down in pressure in a third pressure letdown valve 475 to produce a first LP precooling refrigerant 426. The liquid fraction of the first LP precooling refrigerant 426 is partially vaporized in the LP feed evaporator 483 to produce a first LP vapor precooling refrigerant 427 and a first LP liquid precooling refrigerant 428. The first LP vapor precooling refrigerant 427 is sent to an LP precooling refrigerant separator 494, and subsequently to the suction of the LP compression stage 416B as a part of the LP side stream 413.

The first LP liquid precooling refrigerant 428 is let down in pressure in a fourth pressure letdown valve 476 to produce a first LLP precooling refrigerant 429. The liquid fraction of the first LLP precooling refrigerant 429 is completely vaporized in the LLP feed evaporator 484 to produce a first LLP vapor precooling refrigerant 460. In this context, "completely vaporized" means that at least 95% by weight of the liquid fraction is vaporized. The first LLP vapor precooling refrigerant 460 is sent to an LLP precooling refrigerant separator 495, and subsequently to the suction of the LLP compression stage 416A as a part of the warm low pressure precooling refrigerant 414.

The second portion 461 of the cooled precooling refrigerant may be let down in pressure in a fifth pressure letdown valve 477 to produce a second HP precooling refrigerant 462. The liquid fraction of the second HP precooling refrigerant 462 is partially vaporized in the HP liquefaction refrigerant evaporator 485 to produce a second HP vapor precooling refrigerant 463 and a second HP liquid precooling refrigerant 464. The second HP vapor precooling refrigerant 463 is sent to the HP precooling refrigerant separator 492, and subsequently to the suction of the HP compression stage 416D as a part of the HP side stream 411.

The second HP liquid precooling refrigerant 464 is let down in pressure in a sixth pressure letdown valve 478 to produce a second MP precooling refrigerant 465. The liquid fraction of the second MP precooling refrigerant 465 is partially vaporized in the MP liquefaction refrigerant evaporator 486 to produce a second MP vapor precooling refrigerant 466 and a second MP liquid precooling refrigerant 467. The second MP vapor precooling refrigerant 466 is sent to the MP precooling refrigerant separator 493, and subsequently to the suction of the MP compression stage 416C as a part of the MP side stream 412.

The second MP liquid precooling refrigerant 467 is let down in pressure in a seventh pressure letdown valve 479 to produce a second LP precooling refrigerant 468. The liquid fraction of the second LP precooling refrigerant 468 is partially vaporized in the LP liquefaction refrigerant evaporator 487 to produce a second LP vapor precooling refrigerant 469 and a second LP liquid precooling refrigerant 470. The second LP vapor precooling refrigerant 469 is sent to the LP precooling refrigerant separator 494, and subsequently to the suction of the LP compression stage 416B as a part of the LP side stream 413.

The second LP liquid precooling refrigerant 470 is let down in pressure in an eighth pressure letdown valve 480 to produce a second LLP precooling refrigerant 471. The liquid fraction of the second LLP precooling refrigerant 471 is completely vaporized in the LLP liquefaction refrigerant evaporator 488 to produce a second LLP vapor precooling refrigerant 472. The second LLP vapor precooling refrigerant 472 is sent to the LLP precooling refrigerant separator 495, and subsequently to the suction of the LLP compression stage 416A as a part of the warm low pressure precooling refrigerant 414.

In a preferred arrangement, using a precooling refrigerant of carbon dioxide, the pressure of the warm low pressure precooling refrigerant 414 is between about 5 bara and 30 bara, and the pressure of the compressed precooling refrigerant 415 is between about 50 bara and 120 bara.

In an alternate arrangement, the feed and liquefaction refrigerants may be cooled in the same heat exchangers against the precooling refrigerant. In such an arrangement, the cooled precooling refrigerant 410 is not divided into a first and second portion and separate precooling evaporators for a second cooling circuit are not required. Some examples of precooling refrigerants include propane, propylene, ethane, ethylene, ammonia, carbon dioxide, MR, hydrofluorocarbons such as R-410A, R22, or any other suitable refrigerant.

The temperature of the cooled precooling refrigerant 410 varies with ambient temperature and the approach temperature of the precooling refrigerant condenser 417. For typical hot ambient temperatures, the temperature of the cooled precooling refrigerant 410 is between about 30 degrees Celsius and about 60 degrees Celsius. Depending on the critical temperature of the precooling refrigerant, the precooling process will either be subcritical or transcritical. If the temperature of the cooled precooling refrigerant 410 is lower than the critical temperature, then the process will be subcritical. However, if the temperature of the cooled precooling refrigerant 410 is greater than or equal to the critical temperature, then the process will be transcritical, and will have lower process efficiency than a subcritical operation.

Figure 5:
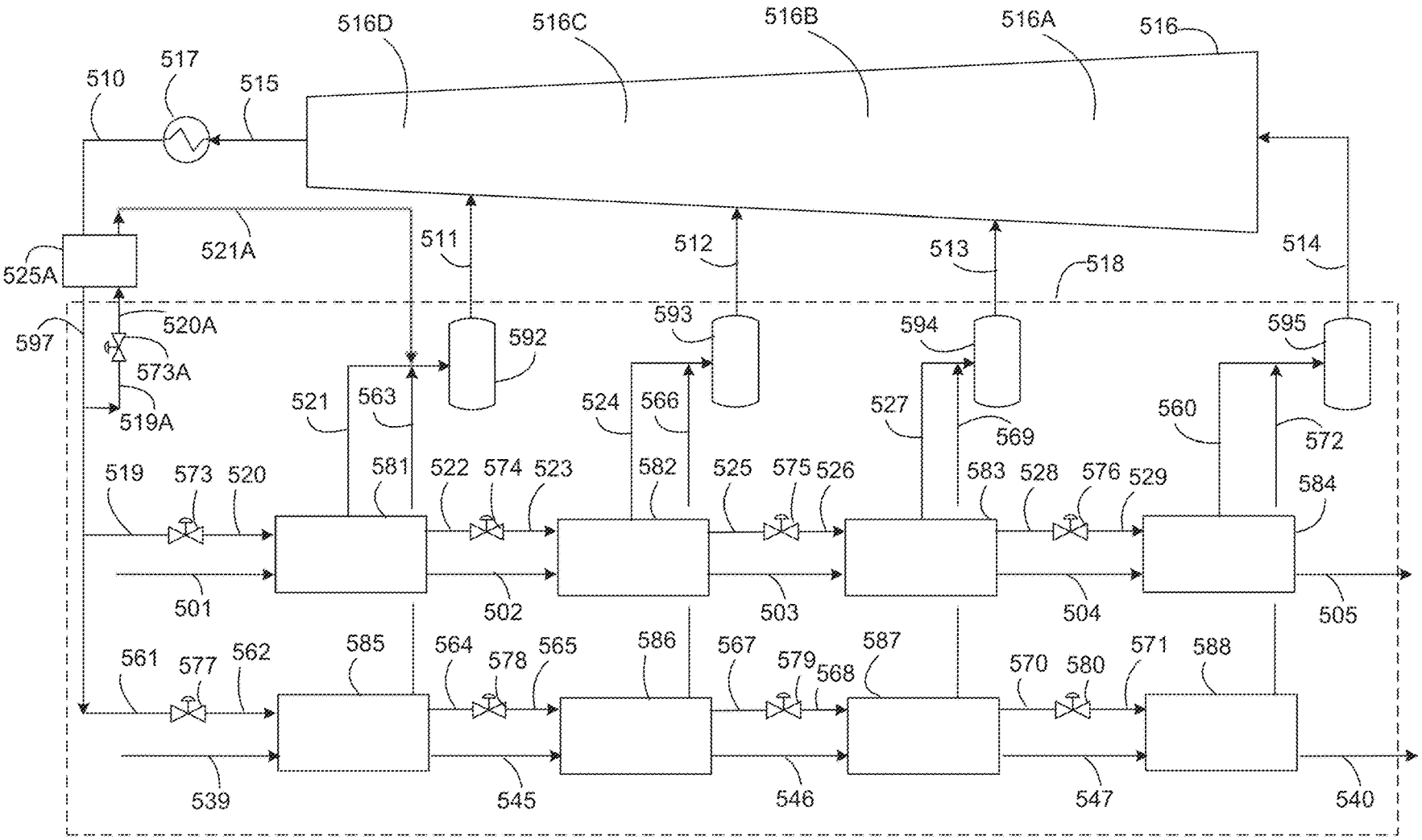
FIG. 5 is a schematic flow diagram of a cooling system in accordance with a first embodiment.

FIG. 5 shows a first exemplary embodiment. Elements of this embodiment that are also shown and described with respect to FIGS. 2 through 4 are identified in FIG. 5 by reference numerals increased by a multiple of 100. For example, the pre-treated feed stream 201 in FIG. 2 corresponds to pre-treated feed stream 501 in FIG. 5. Elements identified in FIG. 5 that do not differ from corresponding elements in FIGS. 2 through 4 may not be discussed in the specification in connection with FIG. 5. Referring to FIG. 5, the compressed precooling refrigerant 515 is cooled in one or more heat exchangers, such as desuperheater, condenser, and/or subcooler heat exchangers, depicted as precooling refrigerant condenser 517, to produce a cooled precooling refrigerant 510 that provides the precooling duty required. The cooled precooling refrigerant 510 is further cooled in an economizer heat exchanger 525A to produce a further cooled precooling refrigerant 597. The temperature of the cooled precooling refrigerant 510 is at ambient temperature plus the approach temperature of the precooling refrigerant condenser 517 also referred to herein as the subcooler heat exchanger approach temperature. The subcooler heat exchanger approach temperature is preferably between about 5 to 40 degrees Celsius and more preferably between about 10 and 30 degrees Celsius. The cooled precooling refrigerant 510 is preferably more than 0 degrees Celsius warmer than the critical temperature, more preferably, more than 10 degrees Celsius warmer than the critical temperature or, most preferably, more than 20 degrees warmer than the critical temperature. The precooling refrigeration process without the economizer heat exchanger is transcritical in nature. The temperature of the further cooled precooling refrigerant 597 is below the critical temperature. As a non-limiting example, the further cooled precooling refrigerant 597 preferably may be more than 0 degrees Celsius colder than the critical temperature or, more preferably, more than 2 degrees colder than the critical temperature.

The further cooled precooling refrigerant 597 is then divided into the first portion of the cooled precooling refrigerant 519 and the second portion of the cooled precooling refrigerant 561, which are used to provide cooling duty to the pre-treated feed stream 501 and the cooled liquefaction refrigerant 539 respectively. In a preferred embodiment, the further cooled precooling refrigerant 597 is at a temperature preferably ranging from about −20 degrees Celsius to about 25 degrees Celsius, and more preferably from about 0 degrees Celsius to about 15 degrees Celsius.

A third portion 519A of the cooled precooling refrigerant is withdrawn from the further cooled precooling refrigerant 597 and is letdown in pressure in a ninth pressure letdown valve 573A to produce a third high pressure precooling refrigerant 520A, which is used to provide the cooling duty in the economizer heat exchanger 525A. The third high pressure precooling refrigerant 520A may be two-phase and is at least partially vaporized and preferably fully vaporized in the economizer heat exchanger 525A to produce third high pressure vapor precooling refrigerant 521A. The third high pressure vapor precooling refrigerant 521A is sent to the HP precooling refrigerant separator 592, and subsequently to the suction of the fourth precooling compression stage 516D as a part of the HP side stream 511. In an alternate embodiment, the economizer heat exchanger 525A may be bypassed during average and cold ambient conditions when the cooled precooling refrigerant 510 is below the critical temperature and the process is already subcritical.

The pressure of the third high pressure precooling refrigerant 520A may optionally be higher than that of the first HP precooling refrigerant 520. In this case, the third high pressure vapor precooling refrigerant 521A may be reduced in pressure in a back-pressure valve or throttling valve (not shown), prior to introduction into the HP precooling refrigerant separator 592. Alternatively, the third high pressure vapor precooling refrigerant 521A may be introduced into the precooling refrigerant compressor(s) 516 at a higher pressure location than the suction of the fourth precooling compression stage 516D, such as at the suction of a fifth precooling compression stage 516E (not shown).

The amount of flow that is used to provide the cooling duty for the economizer heat exchanger 525A via the third portion 519A of the cooled precooling refrigerant will depend upon the composition of the precooling refrigerant. In the embodiment shown in FIG. 5, 3-20% of the flow is preferably directed to the third portion 519A (more preferably 5-15%), 15-45% is preferably directed to the first portion 519, and 45-85% is preferably directed to the second portion 561. Any suitable flow regulation devices, such as proportional valves (not shown) could be used to regulate the desired flow spit.

A benefit of the embodiment shown in FIG. 5 is that it converts a transcritical process into a subcritical process. By further cooling the cooled precooling refrigerant 510 in the economizer heat exchanger 525A, the further cooled precooling refrigerant 597 becomes the "effective" subcooler outlet temperature. Therefore, to determine whether the operation is subcritical or transcritical, the temperature of the further cooled precooling refrigerant 597 would need to be compared to the critical temperature of the refrigerant. Since the further cooled precooling refrigerant 597 is colder than the cooled precooling refrigerant 510, it increases the likelihood of a subcritical cycle. As non-limiting examples, CO2 and ethane have critical temperatures of about 30 degrees Celsius, much lower than the temperature of the cooled precooling refrigerant 510 for typical average and hot ambient conditions. For a process of the prior art, this would lead to transcritical operation with significantly lower the process efficiency, due to higher vapor fraction. For transcritical operation, the vapor fraction of the first HP precooling refrigerant 420 is preferably between about 0.1 and 0.7. Additionally, for a prior art transcritical operation, there would be: no phase change in the heat rejection (to ambient) step; complicated inventory management with ambient temperature swings; a lack of references for baseload LNG facilities as well as other operational challenges. However, using the embodiment described in FIG. 5, the critical temperature of 30 degrees Celsius is preferably greater than the further cooled precooling refrigerant 597, even for hot ambient conditions. As a non-limiting example, using the embodiment of FIG. 5, the further cooled precooling refrigerant 597 may be at a temperature of about 20 degrees Celsius for hot ambient temperature. As a result, the process of FIG. 5 will be subcritical in nature and therefore, have a higher process efficiency than the prior art embodiment of FIG. 4, preferably between 5% and 30% higher efficiency than transcritical prior art processes. The vapor fraction of the first HP precooling refrigerant 520 is preferably between about 0 and 0.5, and more preferably between about 0 and 0.3. The embodiment of FIG. 5 would also not have the challenges with changes in inventory management with ambient temperature swings, as described earlier.

A further benefit of this embodiment is that due to the colder effective subcooler outlet, the pressure of the compressed precooling refrigerant 515 can be lower, which reduces the compression load on the system. In a preferred embodiment, the pressure of the compressed precooling refrigerant 515 is between about 20 bara and 80 bara. Further, the lower pressure reduces the specific heat ratio of the precooling refrigerant. The specific heat ratio is the ratio of the constant pressure specific heat capacity to the constant volume specific heat capacity. As the specific heat ratio reduces, the temperature of the refrigerant after compression reduces, which implies lower lost work and therefore higher process efficiency.

Figure 6:
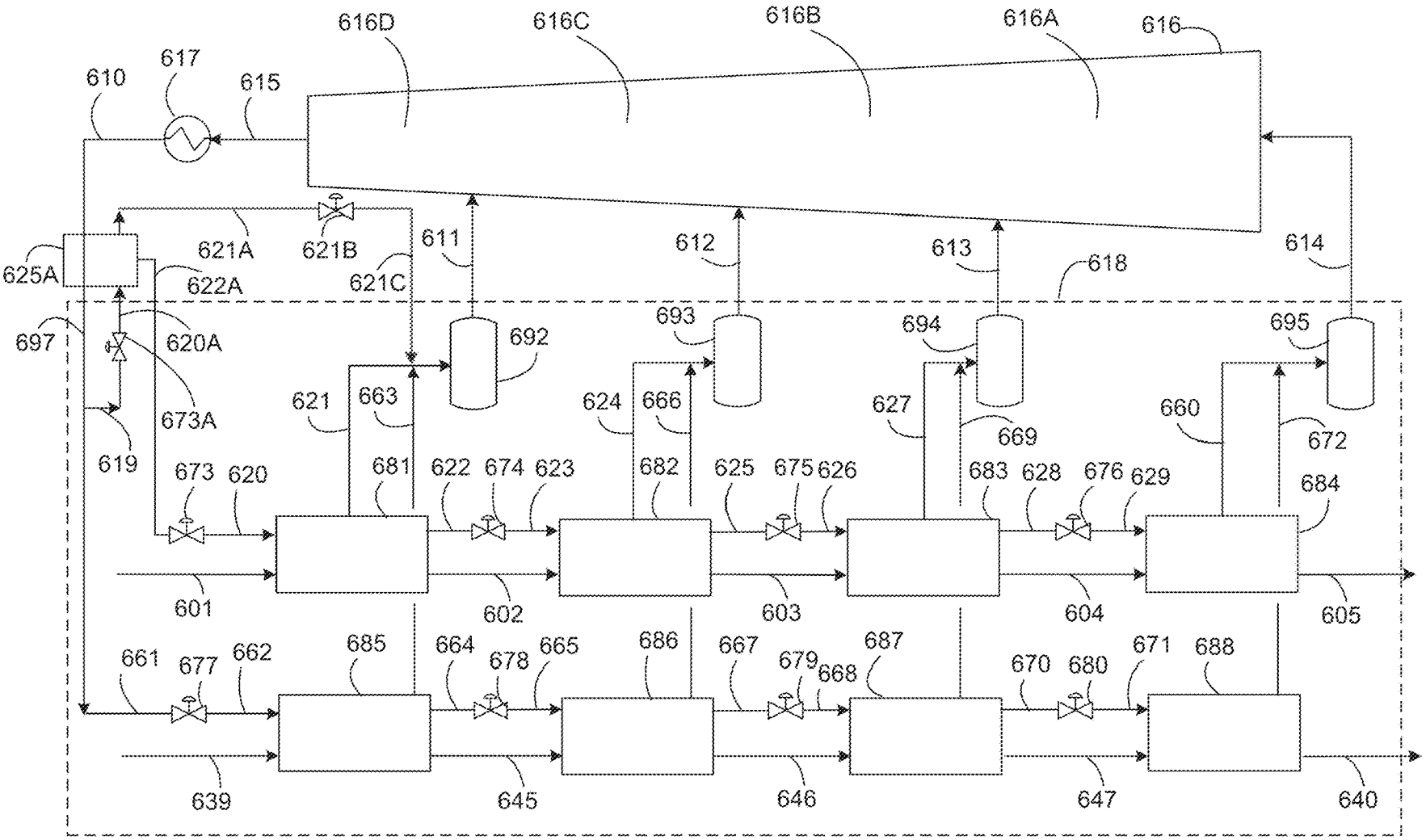
FIG. 6 is a schematic flow diagram of a cooling system in accordance with a second embodiment.

FIG. 6 shows a second exemplary embodiment and a variation of FIG. 5. Elements of this embodiment that are also shown and described with respect to FIGS. 2 through 5 are identified in FIG. 6 by reference numerals increased by a multiple of 100. For example, the pre-treated feed stream 201 in FIG. 2 corresponds to pre-treated feed stream 601 in FIG. 6. Elements identified in FIG. 6 that do not differ from corresponding elements in FIGS. 2 through 5 may not be discussed in the specification in connection with FIG. 6. The further cooled precooling refrigerant 697 is divided into the first portion of the cooled precooling refrigerant 619 and the second portion of the cooled precooling refrigerant 661. The first portion of the cooled precooling refrigerant 619 is letdown in pressure in a ninth pressure letdown valve 673A to produce a third high pressure precooling refrigerant 620A, which is used to provide cooling duty to the economizer heat exchanger 625A. The third high pressure precooling refrigerant 620A is partially vaporized in the economizer heat exchanger 625A and phase separated to produce a third high pressure vapor precooling refrigerant 621A and a third high pressure liquid precooling refrigerant 622A. The phase separation step may occur within the economizer heat exchanger 625A or in a separate phase separator (not shown). The third high pressure vapor precooling refrigerant 621A is sent to the HP precooling refrigerant separator 692, and subsequently to the suction of the fourth precooling compression stage 616D as a part of the HP side stream 611. The third high pressure liquid precooling refrigerant 622A is letdown in pressure in the first pressure letdown device 673 to produce the first high pressure precooling refrigerant 620, which is used to provide cooling duty to the pre-treated feed stream 601, while the second portion of the cooled precooling refrigerant 661 is used to provide cooling duty to the cooled liquefaction refrigerant 639.

The pressure of the third high pressure precooling refrigerant 620A is higher than that of the first HP precooling refrigerant 620. Therefore, the third high pressure vapor precooling refrigerant 621A needs to be reduced in pressure in a back-pressure valve or throttling valve 621B to produce a reduced pressure third high pressure vapor precooling refrigerant 621C, prior to introduction into the HP precooling refrigerant separator 692. Alternatively, the third high pressure vapor precooling refrigerant 621A may be introduced into the precooling refrigerant compressor(s) 616 at a higher pressure location than the suction of the fourth precooling compression stage 616D, such as at the suction of a fifth precooling compression stage 616E (not shown).

In an alternate embodiment, the economizer heat exchanger 625A may be bypassed during average and cold ambient conditions when the cooled precooling refrigerant 610 is below the critical temperature and the process is already subcritical. FIG. 6 has all the benefits of the embodiment shown in FIG. 5.

Figure 7:
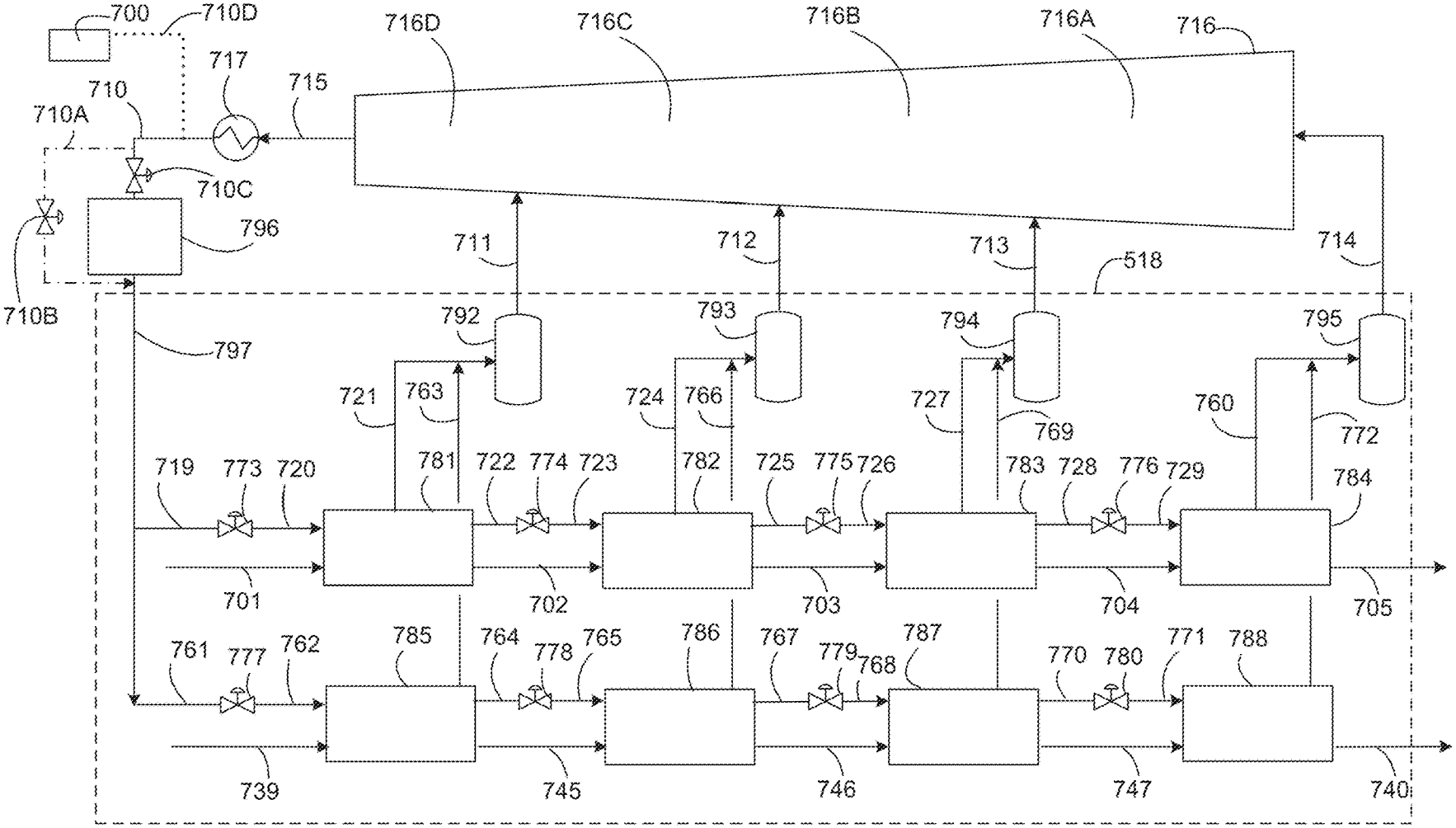
FIG. 7 is a schematic flow diagram of a cooling system in accordance with a third embodiment.

FIG. 7 shows a third exemplary embodiment. Elements of this embodiment that are also shown and described with respect to FIGS. 2 through 6 are identified in FIG. 7 by reference numerals increased by a multiple of 100. For example, the pre-treated feed stream 201 in FIG. 2 corresponds to pre-treated feed stream 701 in FIG. 7. Elements identified in FIG. 7 that do not differ from corresponding elements in FIGS. 2 through 6 may not be discussed in the specification in connection with FIG. 7. Referring to FIG. 7, during a first period of time, the cooled precooling refrigerant 710 is further cooled in an auxiliary refrigerant system 796 to produce a further cooled precooling refrigerant 797. The temperature of the cooled precooling refrigerant 710 is at ambient temperature plus subcooler heat exchanger temperature approach to ambient temperature. The subcooler heat exchanger approach temperature is preferably between about 5 to 40 degrees Celsius and more preferably between about 10 and 30 degrees Celsius. The first period of time is defined as a period of time wherein the cooled precooling refrigerant 710, referred to herein as the "subcooler outlet temperature", is greater than or equal to the critical temperature of the precooling refrigerant. In other words, during the first period of time, the temperature of the cooled precooling refrigerant 710 is greater than or equal to the critical temperature. As a non-limiting example, the cooled precooling refrigerant 710 may be more than 0 degrees Celsius warmer than the critical temperature or more than 10 degrees Celsius warmer than the critical temperature or more than 20 degrees warmer than the critical temperature. Therefore, during the first period of time, the precooling refrigeration process without the auxiliary refrigerant system, is transcritical in nature. As a non-limiting example, the first period of time may take place during hot and average ambient conditions, including, but not limited to, summer months and/or warm days. The temperature of the further cooled precooling refrigerant 797 is below the critical temperature. As a non-limiting example, the further cooled precooling refrigerant 797 preferably may be more than 0 degrees Celsius colder than the critical temperature, more preferably more than 2 degrees colder than the critical temperature or, most preferably, more than 5 degrees colder than the critical temperature.

The further cooled precooling refrigerant 797 is then divided into the first portion of the cooled precooling refrigerant 719 and the second portion of the cooled precooling refrigerant 761, which are used to provide cooling duty to the pre-treated feed stream 701 and the cooled liquefaction refrigerant 739 respectively. In a preferred embodiment, the further cooled precooling refrigerant 797 is at a temperature preferably ranging from about −20 degrees Celsius to about 25 degrees Celsius, and more preferably from about 0 degrees Celsius to about 15 degrees Celsius. During the first period of time, the precooling refrigeration process with the auxiliary refrigerant system, is subcritical in nature.

During a second period of time, the cooled precooling refrigerant 710 optionally bypasses the auxiliary refrigerant system 796 via the optional bypass precooling refrigerant 710A, which is then divided into the first portion of the cooled precooling refrigerant 719 and the second portion of the cooled precooling refrigerant 761. The second period of time is defined as a period of time wherein the subcooler outlet temperature is lower than the critical temperature of the precooling refrigerant. In other words, during the second period of time, the temperature of the cooled precooling refrigerant 710 is lower than the critical temperature. Therefore, during the second period of time, the precooling refrigeration process without the auxiliary refrigerant system, is subcritical in nature. As a non-limiting example, the second period of time may take place during cold ambient conditions, such as winter months and/or cold nights. As a non-limiting example, the cooled precooling refrigerant 710 preferably may be more than 10 degrees Celsius colder than the critical temperature, more preferably, more than 15 degrees colder than the critical temperature.

The auxiliary refrigerant system may utilize any heat transfer method, such as boiling heat transfer where the refrigerant evaporates to provide the cooling duty, or sensible heat transfer where the refrigerant warms up without changing phase to provide the cooling duty or a combination of both. The heat transfer method may also be absorption heat transfer where the refrigerant evaporates to provide the cooling duty but the compression step is replaced by additional equipment. Further, the auxiliary refrigerant system could use any number of heat exchangers. As a non-limiting example, the auxiliary refrigerant may be propane or a mixed refrigerant or a gas phase refrigeration process using feed gas. The auxiliary refrigerant may also be any suitable absorptive refrigerant.

Any suitable system could be used to monitor the temperature of the cooled precooling refrigerant 710 and control flow through the bypass 710A and the auxiliary refrigerant system 796. For example, a controller 700 could be used to control valves 710B and 710C based on temperature sensed by a sensor 710D. When the sensor 710D senses that the cooled precooling refrigerant 710 is greater than or equal to the critical temperature, the controller 700 closes valve 710B and opens valve 710C. Conversely, when the sensor 710D senses that the cooled precooling refrigerant 710 is below the critical temperature, the controller 700 opens valve 710B and closes valve 710C.

A benefit of the embodiment shown in FIG. 7 is that it converts a transcritical process into a subcritical process by further cooling the cooled precooling refrigerant 710 in the auxiliary refrigerant system 796. The further cooled precooling refrigerant 797 becomes the "effective" subcooler outlet temperature. Therefore, to determine whether the operation is subcritical or transcritical, the temperature of the further cooled precooling refrigerant 797 would need to be compared to the critical temperature of the refrigerant. Since the further cooled precooling refrigerant 797 is much colder than the cooled precooling refrigerant 710, it increases the likelihood of a subcritical cycle. As a non-limiting example, CO2 and ethane have critical temperatures of about 30 degrees Celsius, much lower than the temperature of the cooled precooling refrigerant 710 for typical average and hot ambient conditions. For a process of the prior art, this would lead to transcritical operation with significantly lower process efficiency, due to higher vapor fraction. For transcritical operation, the vapor fraction of the first HP precooling refrigerant 420 is preferably between about 0.1 and 0.7. Additionally, for a prior art transcritical operation, there would be no phase change in the heat rejection (to ambient) step, complicated inventory management with ambient temperature swings, lack of references for baseload LNG facilities, as well as other operational challenges. However, using the embodiment described in FIG. 7, the critical temperature of 30 degrees Celsius is preferably greater than the further cooled precooling refrigerant 797, even for hot ambient conditions. As a non-limiting example, using the embodiment of FIG. 7, the further cooled precooling refrigerant 797 may be at a temperature of about 10 degrees Celsius for hot ambient temperature. As a result, the process of FIG. 7 will be subcritical in nature and therefore, have a much higher process efficiency than the prior art embodiment of FIG. 4. Preferably, between 10% and 30% higher efficiency than transcritical prior art processes is obtained. Further, the embodiments, when applied to an transcritical process, will have significantly higher benefit than when applied to an already subcritical process, where the benefit is about 5 to 15%. The vapor fraction of the first HP precooling refrigerant 720 is preferably between about 0 and 0.5, and more preferably between about 0 and 0.3. The embodiment of FIG. 7 also does not have the challenges of changes in inventory management with ambient temperature swings, as described earlier.

A further benefit of this embodiment is that due to the colder effective subcooler outlet, the pressure of the compressed precooling refrigerant 715 can be lower, which reduces the compression load on the system. In a preferred embodiment, the pressure of the compressed precooling refrigerant 715 is between about 20 bara and 80 bara. Further, the lower pressure reduces the specific heat ratio of the precooling refrigerant. The specific heat ratio is the ratio of the constant pressure specific heat capacity to the constant volume specific heat capacity. As the specific heat ratio reduces, the temperature of the refrigerant after compression reduces, which implies lower lost work and therefore higher process efficiency.

The higher process efficiency of the embodiment of FIG. 7 makes it optimal to shift more load into the precooling system by reducing the precooling temperature, and lowering the load on the liquefaction system. As a non-limiting example, the temperature of the pre-cooled natural gas stream 705 may be between about −30 degrees Celsius to about −60 degrees Celsius, whereas the temperature of the pre-cooled natural gas stream 405 may be between about −10 degrees Celsius to about −40 degrees Celsius.

In the embodiment shown in FIG. 7 the auxiliary refrigerant system cools the precooling refrigerant, however it may also be used to cool the liquefaction refrigerant. This is also applicable to an embodiment where there is no dedicated precooling refrigerant and the auxiliary refrigerant system cools the liquefaction refrigerant.

In a preferred embodiment, the liquefaction refrigerant is MR and the precooling refrigerant is ethane or CO2. In another preferred embodiment, the liquefaction refrigerant is gas phase N2 and the precooling refrigerant is ethane or CO2. In yet another preferred embodiment, the liquefaction refrigerant is methane and the precooling refrigerant is ethane or CO2. The benefit of using CO2 as the precooling refrigerant is that it is non-flammable, easily available, and has a high density. Its high density leads to a lower volumetric flowrate of precooling refrigerant required for the same mass of refrigerant. The higher density also reduces precooling system piping and equipment sizes. In a further preferred embodiment using CO2 as the precooling refrigerant, the CO2 is produced in the LNG facility in the acid gas removal unit (AGRU).

In an alternative embodiment, during the first period of time, ambient air or water is cooled against the auxiliary refrigerant in the auxiliary heat exchanger to produce a cooled ambient stream. During the second period of time, the auxiliary refrigerant system is optionally bypassed. In such an arrangement, the precooling refrigerant is cooled against the cooled ambient stream instead of the auxiliary refrigerant.

Figure 8:
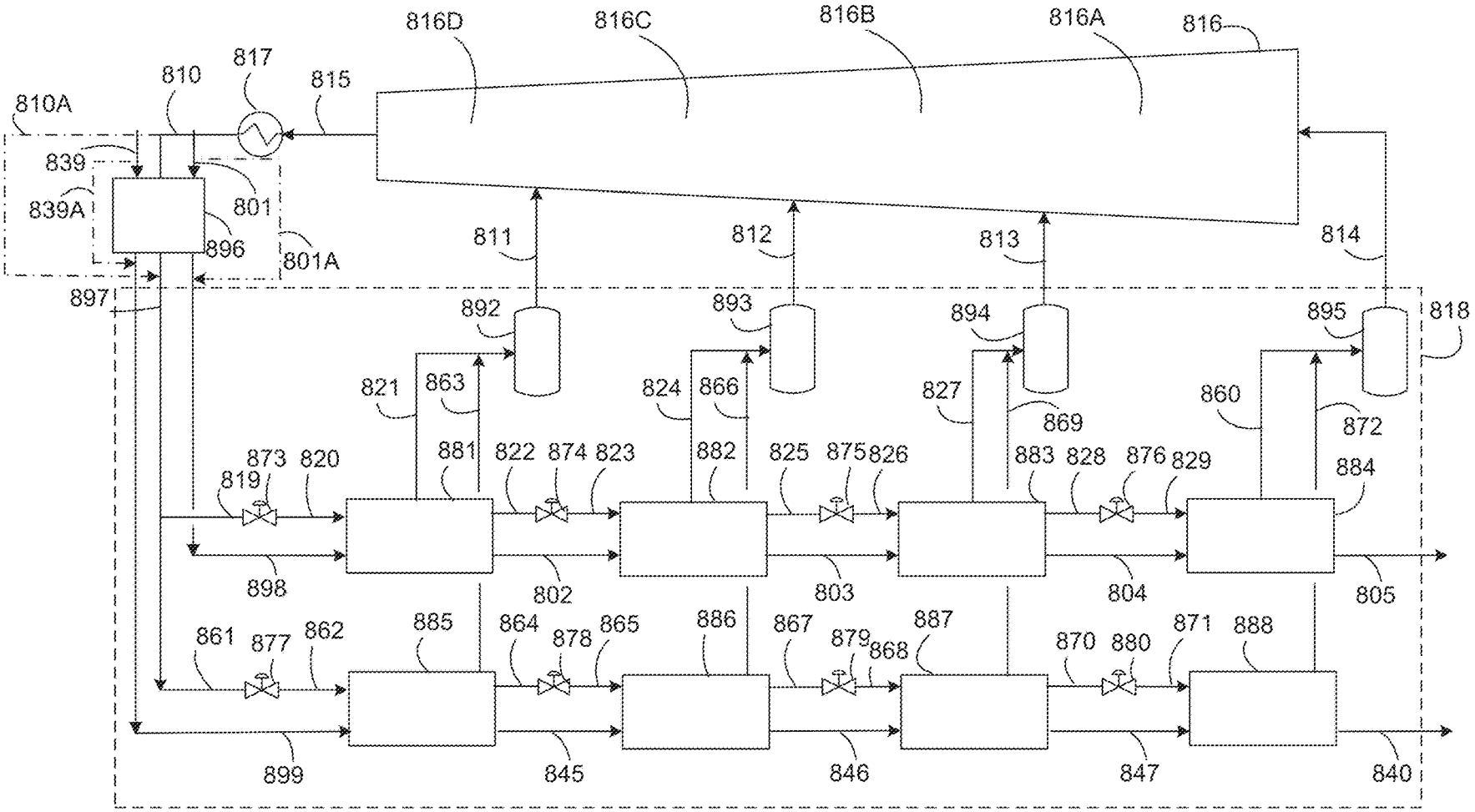
FIG. 8 is a schematic flow diagram of a cooling system in accordance with a fourth embodiment.

FIG. 8 shows a fourth embodiment, which is a variation of the embodiment shown in FIG. 7. Elements of this embodiment that are also shown and described with respect to FIGS. 2 through 7 are identified in FIG. 8 by reference numerals increased by a multiple of 100. For example, the pre-treated feed stream 201 in FIG. 2 corresponds to pre-treated feed stream 801 in FIG. 8. Elements identified in FIG. 8 that do not differ from corresponding elements in FIGS. 2 through 7 may not be discussed in the specification in connection with FIG. 8. During the first period of time, the cooled precooling refrigerant 810 is further cooled in an auxiliary refrigerant system 896 to produce a further cooled precooling refrigerant 897. Further, the pre-treated feed stream 801 is cooled in the auxiliary refrigerant system 896 to produce a further cooled feed stream 898, which is then sent to the HP feed evaporator 881 to be precooled. The cooled liquefaction refrigerant 839 is cooled in the auxiliary refrigerant system 896 to produce a further cooled MR stream 899, which is then sent to the HP Liquefaction refrigerant evaporator 885 to be precooled.

During the second period of time, the auxiliary refrigerant system is optionally bypassed via an optional bypass precooling refrigerant 810A, an optional bypass feed stream 801A, and an optional bypass liquefaction refrigerant 839A.

In a preferred embodiment, the further cooled precooling refrigerant 897, the further cooled feed stream 898, and the further cooled MR stream 899 are at a temperature preferably ranging from about −20 degrees Celsius to about 25 degrees Celsius, more preferably from about 0 degrees Celsius to about 15 degrees Celsius.

This embodiment has all the benefits of FIG. 7. Additionally, since the feed and MR streams are also cooled in the auxiliary refrigerant system 896 during the first period of time, the process efficiency for FIG. 8 is higher than that for FIG. 7, for a minimal increase in capital cost.

In an alternative embodiment, an intermediate compressed stream from the precooling refrigerant system or the liquefaction refrigerant system is withdrawn and cooled against the auxiliary refrigerant system 896 prior to being further compressed.

Figure 9:
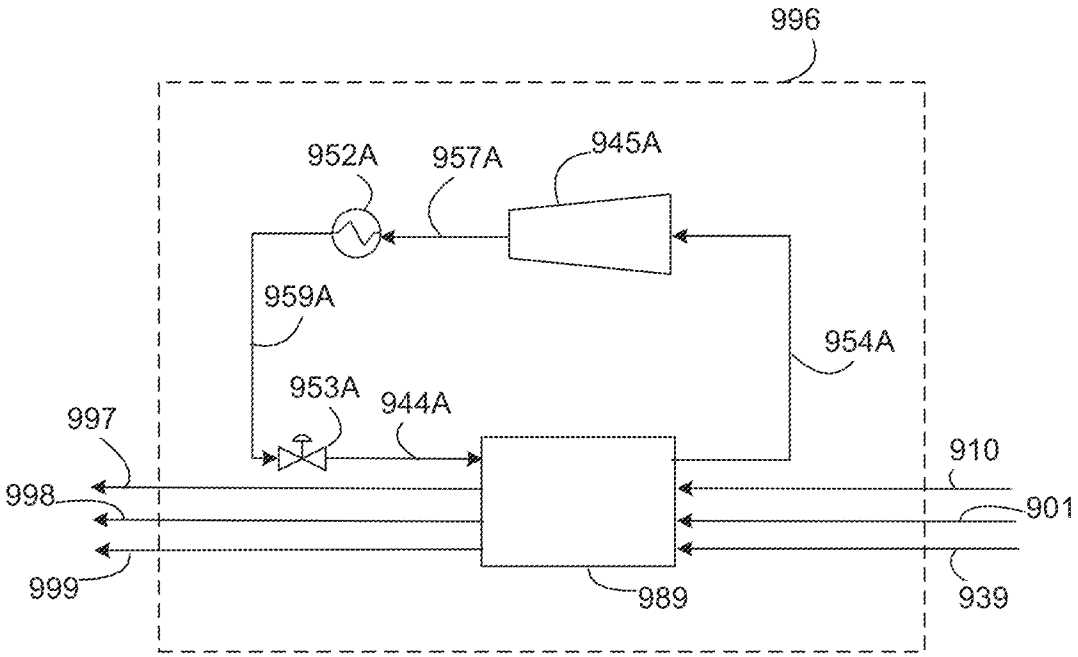
FIG. 9 is a schematic flow diagram of a first embodiment of an auxiliary refrigerant system in accordance with the third and fourth embodiments.

FIG. 9 shows an exemplary embodiment of the auxiliary refrigerant system 996, as applied to FIG. 8. Elements of this embodiment that are also shown and described with respect to FIGS. 2 through 8 are identified in FIG. 9 by reference numerals increased by a multiple of 100. For example, the pre-treated feed stream 201 in FIG. 2 corresponds to pre-treated feed stream 901 in FIG. 9. Elements identified in FIG. 9 that do not differ from corresponding elements in FIGS. 2 through 8 may not be discussed in the specification in connection with FIG. 9. The cooled precooling refrigerant 910 is further cooled in an auxiliary heat exchanger 989 to produce a further cooled precooling refrigerant 997. The pre-treated feed stream 901 is cooled in the auxiliary heat exchanger 989 to produce the further cooled feed stream 998. The cooled liquefaction refrigerant 939 is cooled in the auxiliary heat exchanger 989 to produce the further cooled MR stream 999.

The auxiliary refrigerant system is based on boiling heat transfer. A vapor auxiliary refrigerant 954A is withdrawn from the warm end of the auxiliary heat exchanger 989 and is compressed in auxiliary refrigerant compressor 945A to produce a high pressure vapor auxiliary refrigerant 957A. The high pressure vapor auxiliary refrigerant 957A is cooled in one or more heat exchangers, represented by an auxiliary refrigerant condenser 952A to produce a cooled auxiliary refrigerant 959A. The cooled auxiliary refrigerant 959A is letdown in pressure in an auxiliary refrigerant letdown valve 953A to produce a low pressure auxiliary refrigerant 944A. The liquid component of the low pressure auxiliary refrigerant 944A is evaporated in the auxiliary heat exchanger 989 to provide the auxiliary cooling duty required and to produce the vapor auxiliary refrigerant 954A.

In an alternative exemplary embodiment of FIG. 9, as applied to FIG. 7, only the cooled precooling refrigerant 910 is further cooled in the auxiliary heat exchanger 989 to produce the further cooled precooling refrigerant 997.

In a preferred embodiment, the auxiliary refrigerant is an HFC refrigerant, including, but not limited to, R-410A or R-22. In another preferred embodiment, the auxiliary refrigerant is propane or ammonia or any other two-phase refrigerant.

Figure 10:
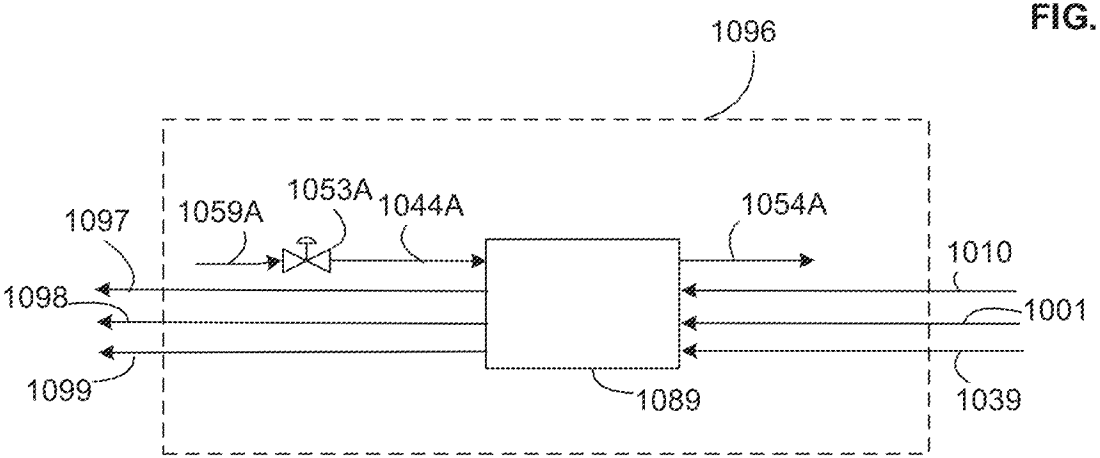
FIG. 10 is a schematic flow diagram of a second embodiment of the auxiliary refrigerant system in accordance with the third and fourth embodiments.

FIG. 10 shows another exemplary embodiment of the auxiliary refrigerant system 1096, as applied to FIG. 8. Elements of this embodiment that are also shown and described with respect to FIGS. 2 through 9 are identified in FIG. 10 by reference numerals increased by a multiple of 100. For example, the pre-treated feed stream 201 in FIG. 2 corresponds to pre-treated feed stream 1001 in FIG. 10. Elements identified in FIG. 10 that do not differ from corresponding elements in FIGS. 2 through 9 may not be discussed in the specification in connection with FIG. 10. The cooled precooling refrigerant 1010 is further cooled in an auxiliary heat exchanger 1089 to produce a further cooled precooling refrigerant 1097. The pre-treated feed stream 1001 is cooled in the auxiliary heat exchanger 1089 to produce the further cooled feed stream 1098. The cooled liquefaction refrigerant 1039 is cooled in the auxiliary heat exchanger 1089 to produce the further cooled MR stream 1099.

The auxiliary refrigerant is a portion of the liquefaction refrigerant. In one embodiment wherein the liquefaction refrigerant uses boiling heat transfer, as shown in FIG. 3, a portion of the MRL stream 341 is removed as the cooled auxiliary refrigerant 1059A. The cooled auxiliary refrigerant 1059A is letdown in pressure in an auxiliary refrigerant letdown valve 1053A to produce a low pressure auxiliary refrigerant 1044A. The liquid component of the low pressure auxiliary refrigerant 1044A is evaporated in the auxiliary heat exchanger 1089 to provide the auxiliary cooling duty required and to produce the vapor auxiliary refrigerant 1054A. The vapor auxiliary refrigerant 1054A may be returned to the liquefaction refrigerant compression system, by introducing into the medium pressure suction drum 353 or any other suitable location.

In an alternative embodiment, the cooled auxiliary refrigerant 1059A may be obtained from any other location of the liquefaction process, such that it may not be condensed and the vapor auxiliary refrigerant 1054A may be returned to any location of the liquefaction process.

In another embodiment, wherein the liquefaction refrigerant uses sensible heat transfer, as shown in FIG. 2, a portion of precooled liquefaction refrigerant 240 is removed as the cooled auxiliary refrigerant 1059A. The cooled auxiliary refrigerant 1059A is letdown in pressure in an auxiliary refrigerant letdown valve 1053A, which may be an expander, to produce a low pressure auxiliary refrigerant 1044A. The low pressure auxiliary refrigerant 1044A is warmed in the auxiliary heat exchanger 1089 to provide the auxiliary cooling duty required and to produce the vapor auxiliary refrigerant 1054A. The vapor auxiliary refrigerant 1054A may be returned to the liquefaction refrigerant compression system, by introducing into the HP compressor 257 or any other suitable location. The vapor auxiliary refrigerant 1054A may also be compressed prior to returning to the liquefaction refrigerant system.

In an alternative exemplary embodiment of FIG. 10, as applied to FIG. 7, only the cooled precooling refrigerant 1010 is further cooled in the auxiliary heat exchanger 1089 to produce the further cooled precooling refrigerant 1097.

In preferred embodiments, the auxiliary refrigerant is mixed refrigerant (MR) or nitrogen.

In a further alternative embodiment, the auxiliary refrigerant is comprised of a portion of the pretreated feed stream 1001 instead of the liquefaction refrigerant of FIG. 2. The vapor auxiliary refrigerant 1054A may be returned to an upstream location in the facility, such as upstream of a feed compressor, or may be used as fuel in the facility.

Figure 11:
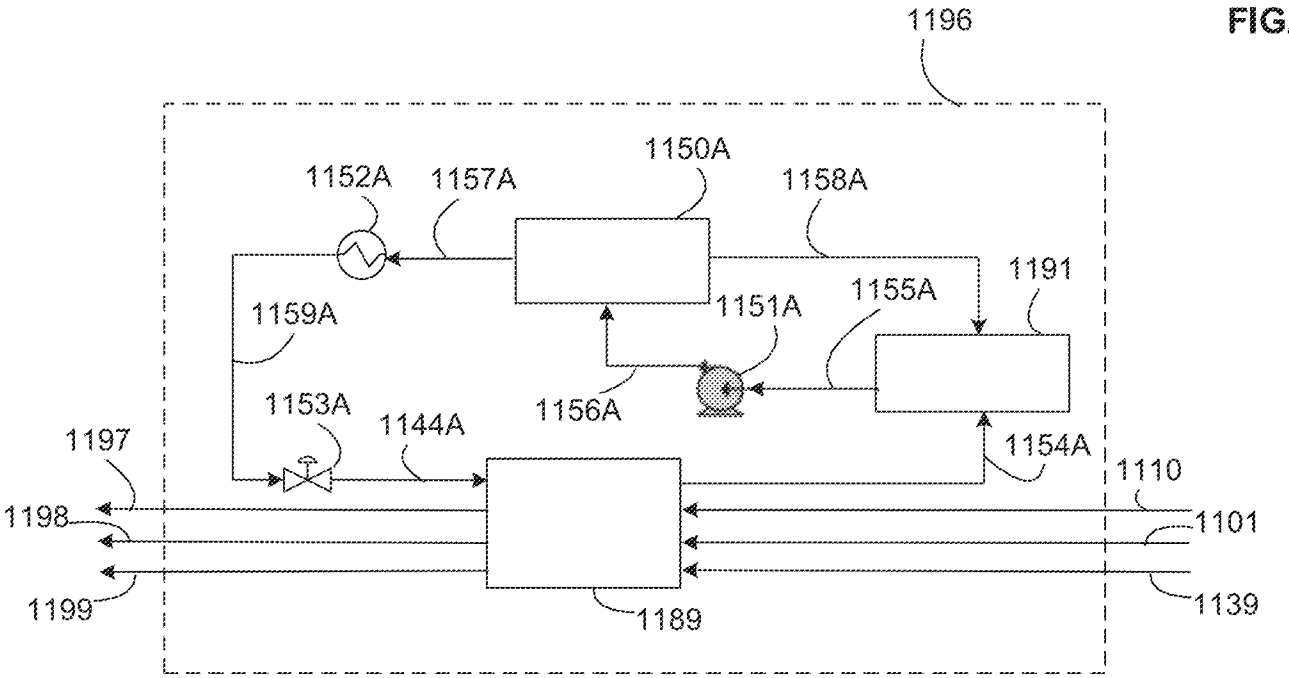
FIG. 11 is a schematic flow diagram of a third embodiment of the auxiliary refrigerant system in accordance with the third and fourth embodiments.

FIG. 11 shows another exemplary embodiment of the auxiliary refrigerant system 1196, as applied to FIG. 8, using an absorption based process. Elements of this embodiment that are also shown and described with respect to FIGS. 2 through 10 are identified in FIG. 11 by reference numerals increased by a multiple of 100. For example, the pre-treated feed stream 201 in FIG. 2 corresponds to pre-treated feed stream 1101 in FIG. 10. Elements identified in FIG. 11 that do not differ from corresponding elements in FIGS. 2 through 10 may not be discussed in the specification in connection with FIG. 11. The cooled precooling refrigerant 1110 is further cooled in an auxiliary heat exchanger 1189 to produce a further cooled precooling refrigerant 1197. The pre-treated feed stream 1101 is cooled in the auxiliary heat exchanger 1189 to produce the further cooled feed stream 1198. The cooled liquefaction refrigerant 1139 is cooled in the auxiliary heat exchanger 1189 to produce the further cooled MR stream 1199.

A vapor auxiliary refrigerant 1154A is withdrawn from the warm end of the auxiliary heat exchanger 1189 and is sent to an auxiliary refrigerant absorber 1191, where the vapor auxiliary refrigerant 1154A is absorbed into an auxiliary refrigerant solvent 1158A to produce a low pressure liquid auxiliary refrigerant 1155A. The low pressure liquid auxiliary refrigerant 1155A is pumped in an auxiliary refrigerant pump 1151A to produce a high pressure liquid auxiliary refrigerant 1156A, which is sent to an auxiliary refrigerant generator 1150A, where heat is provided to separate a high pressure vapor auxiliary refrigerant 1157A from the auxiliary refrigerant solvent 1158A, which is sent to the auxiliary refrigerant absorber 1191. The high pressure vapor auxiliary refrigerant 1157A is cooled in one or more heat exchangers, depicted by an auxiliary refrigerant condenser 1152A to produce a cooled auxiliary refrigerant 1159A. The cooled auxiliary refrigerant 1159A is letdown in pressure in an auxiliary refrigerant letdown valve 1153A to produce a low pressure vapor auxiliary refrigerant 1144A. The low pressure vapor auxiliary refrigerant 1144A is evaporated in the auxiliary heat exchanger 1189 to provide the auxiliary cooling duty required.

In one embodiment, the heat provided to the auxiliary refrigerant generator 1150A is obtained from waste heat generated in the natural gas liquefaction facility. In another embodiment, waste heat generated from liquefaction and precooling gas turbines driving liquefaction and precooling compressors, is utilized in the auxiliary refrigerant generator 1150A.

In an alternative exemplary embodiment of FIG. 11, as applied to FIG. 7, only the cooled precooling refrigerant 1110 is further cooled in the auxiliary heat exchanger 1189 to produce the further cooled precooling refrigerant 1197. In one embodiment, the auxiliary refrigerant is an aqueous LiBr solution.

Although the embodiments described here suggest use of the auxiliary refrigerant in the precooling system, it may also be used for the liquefaction, subcooling, or any step of the process.

Figure 1B:
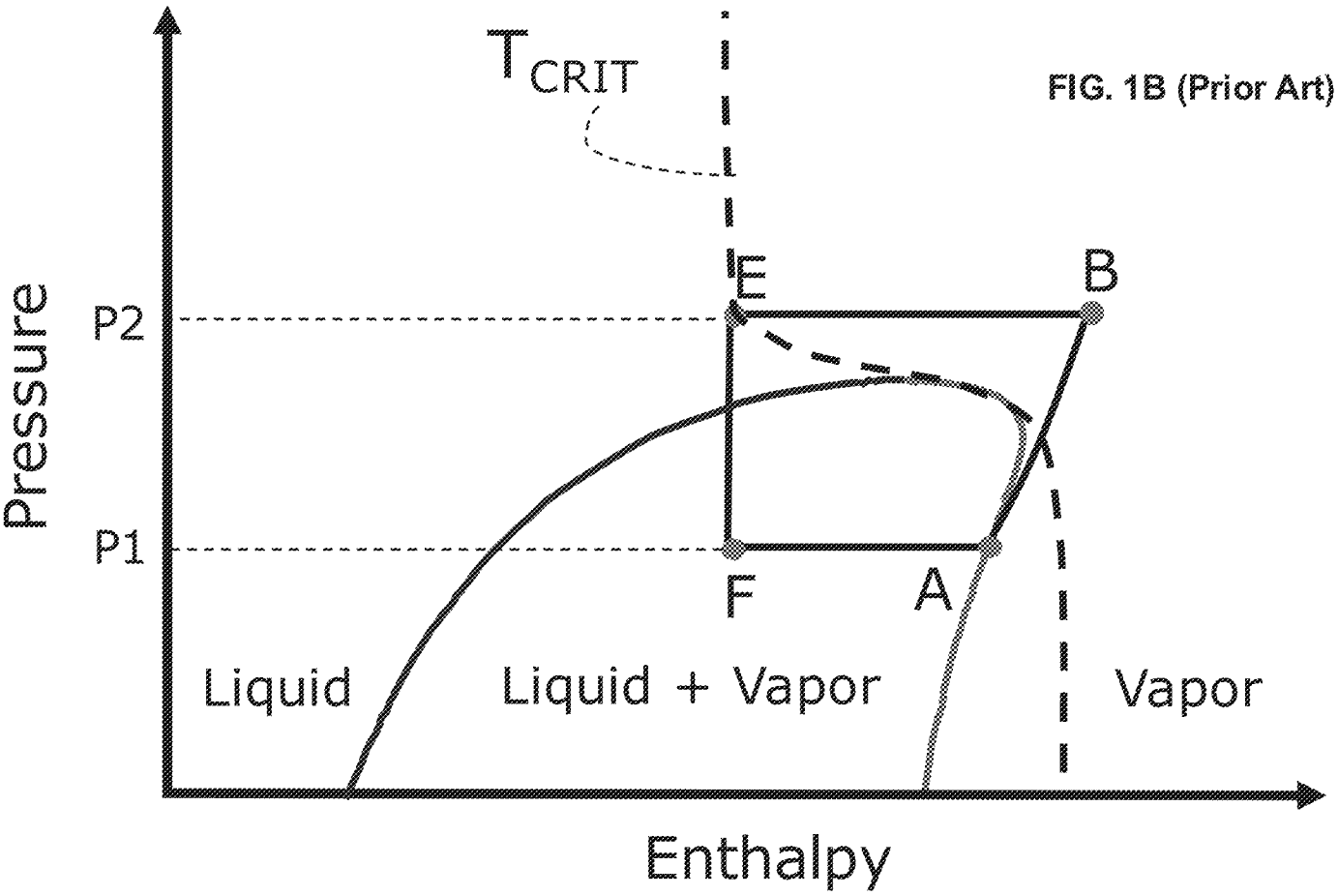
FIG. 1B (Prior Art)
FIG. 1B is a pressure versus enthalpy (P-H) diagram for a transcritical cooling process in accordance with the prior art.
Figure 12A:
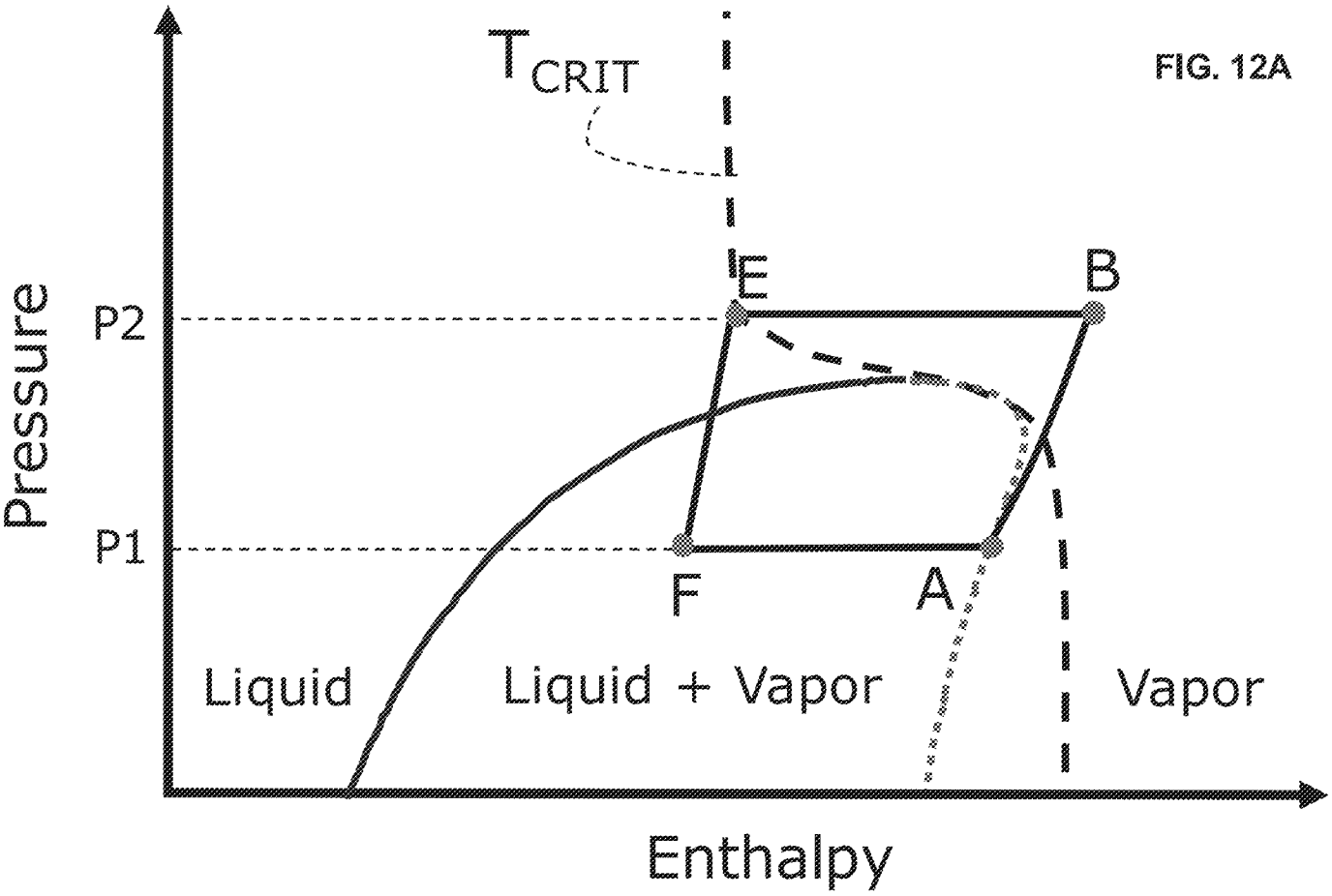
FIG. 12A is a pressure versus enthalpy (P-H) diagram for a transcritical cooling process with isentropic expansion.
Figure 12B:
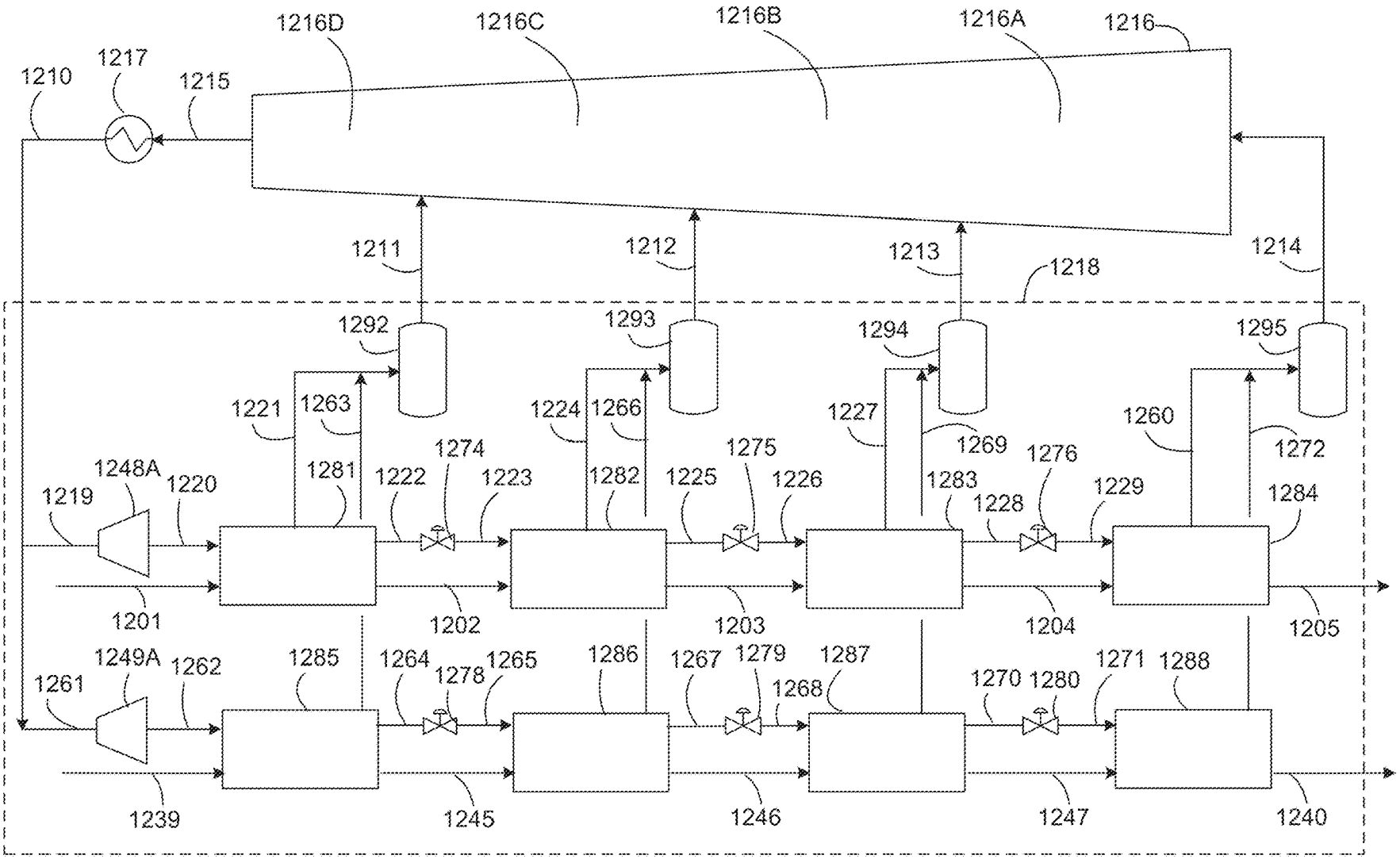
FIG. 12B is a schematic flow diagram of a cooling system in accordance with a fifth embodiment.

Typical pressure letdown valves, such as Joule-Thomson (JT) valves, are isenthalpic in nature. A representation of an isenthalpic pressure letdown step in a transcritical process in shown on a P-H diagram in FIG. 1B. Line E-F represents the isenthalpic pressure letdown step and due to the vertical nature of the line, results in a high vapor fraction at point F. This results in low process efficiency. FIGS. 5-11 discuss embodiments for converting a transcritical process to a subcritical one and therefore, improve the process efficiency. An alternative way to improve the process efficiency is to move point F to the left by performing step E-F in an isentropic manner, as shown in FIG. 12A. Due to the shape of isentropic (constant entropy) lines in a P-H diagram, without moving point E, it is possible for point F to have a lower vapor fraction. FIG. 12B shows a fifth embodiment, using isentropic expansion.

Referring to FIG. 12B, the compressed precooling refrigerant 1215 is cooled by indirect heat exchange against ambient air or water in one or more heat exchangers, depicted by precooling refrigerant condenser 1217 to produce the cooled precooling refrigerant 1210. The cooled precooling refrigerant 1210 is then divided into two portions, a first portion 1219 to provide cooling duty to the pre-treated feed stream 1201, and a second portion 1261 to provide cooling duty to the cooled liquefaction refrigerant 1239.

The first portion of the cooled precooling refrigerant 1219 is let down in pressure in a first dual phase expander 1248A to produce a first HP precooling refrigerant 1220. The liquid fraction of the first HP precooling refrigerant 1220 is partially vaporized in the HP feed evaporator 1281 to produce a first HP vapor precooling refrigerant 1221 and a first HP liquid precooling refrigerant 1222. The first HP vapor precooling refrigerant 1221 is sent to an HP precooling refrigerant separator 1292, and subsequently to the suction of the fourth precooling compression stage 1216D as a part of the HP side stream 1211.

The second portion of the cooled precooling refrigerant 1261 may be let down in pressure in a second dual phase expander 1249A to produce a second HP precooling refrigerant 1262. The liquid fraction of the second HP precooling refrigerant 1262 is partially vaporized in the HP liquefaction refrigerant evaporator 1285 to produce a second HP vapor precooling refrigerant 1263 and a second HP liquid precooling refrigerant 1264. The second HP vapor precooling refrigerant 1264 is sent to the HP precooling refrigerant separator 1292, and subsequently to the suction of the fourth precooling compression stage 1216D as a part of the HP side stream 1211. The vapor fraction of the first HP precooling refrigerant 1220 and the second HP precooling refrigerant 1262 is preferably between about 0.2 and 0.6, and more preferably between about 0.2 and 0.4. In contrast, the vapor fraction of the first HP precooling refrigerant 420 of the prior art is preferably between about 0.1 and 0.7.

A benefit of the embodiment of FIG. 12B is that the process efficiency can be improved at low capital cost, plot space, and complexity. Another benefit of using an expander is that useful work can be extracted from it, leading to lower power requirement. Since this embodiment does not convert a transcritical process to a subcritical one, the inventory management issues remain. To solve this issue, the embodiment of FIG. 12B may be combined with any of the embodiments described previously, such as the embodiments shown in FIGS. 5-11. In one embodiment, the cooled precooling refrigerant 1210 may be further cooled in the economizer heat exchanger 525A of FIG. 5 to produce a further cooled precooling refrigerant 597 prior to performing the isentropic pressure letdown step. In another embodiment, the cooled precooling refrigerant 1210 may be further cooled in the auxiliary refrigerant system 796 to produce a further cooled precooling refrigerant 797 prior to performing the isentropic pressure letdown step. Combining the features of FIG. 12B with the previous embodiments allows for improving the efficiency of the process and at the same time converting a transcritical process to a subcritical one, which further improves process efficiency and resolves refrigerant inventory management issues.

Example 1

The following is an example of an exemplary embodiment. The example process and data are based on simulations of a precooling and liquefaction process at a plant that produces nominally 5 million metric tonnes per annum (MTPA) of LNG. The precooling refrigerant for this example is either ethane or carbon dioxide and the liquefaction refrigerant may be either MR or N2. This example specifically refers to the embodiment shown in FIG. 5 but is also applicable to FIG. 6 and other related embodiments. The ambient temperature is of 77 degrees Fahrenheit (25 degrees Celsius). The critical temperature of ethane and carbon dioxide is about 30 degrees Celsius.

Referring to FIG. 5, the cooled precooling refrigerant 510 is further cooled in an economizer heat exchanger 525A to produce a further cooled precooling refrigerant 597. The cooled precooling refrigerant 510 is at psia (85 bara), 90 degrees Fahrenheit (32 degrees Celsius) and supercritical. The further cooled precooling refrigerant 597 is at 81 degrees Fahrenheit (27 degrees Celsius) and liquid phase. The third portion of the cooled precooling refrigerant 519A is 15 mole % of the further cooled precooling refrigerant 597. The process efficiency of this embodiment is about 4% higher than the prior art.

Example 2

The following is an example of an exemplary embodiment. The example process and data are based on simulations of a precooling and liquefaction process at a plant that produces nominally 5 MTPA of LNG. The precooling refrigerant for this example is either ethane or carbon dioxide and the liquefaction refrigerant may be either MR or N2. This example specifically refers to the embodiment shown in FIG. 7 but is also applicable to other embodiments. The first period of time occurs during average ambient temperature of 77 degrees Fahrenheit (25 degrees Celsius) and the second period of time occurs during cold ambient temperature of 52 degrees Fahrenheit (11 degrees Celsius). To simplify the description of this example, elements and reference numerals described with respect to the embodiment shown in FIG. 7 will be used. Reference numerals described with respect to the embodiment shown in FIG. 4 (prior art) will also be used for comparison.

During the first period of time, a pre-treated feed stream 701 at a temperature of 70 degrees Fahrenheit (21 degrees Celsius), pressure of 834 psia (57.5 bara), and 82,000 lbmol/hr (37,196 kgmol/hr) is cooled by indirect heat exchange in an HP feed evaporator 781 to produce a first intermediate feed stream 702 at temperature of 35 degrees Fahrenheit (2 degrees Celsius), which is then cooled in an MP feed evaporator 782 to produce a second intermediate feed stream 703 at a temperature of 8 degrees Fahrenheit (−14 degrees Celsius), followed by a LP feed evaporator 783 to produce a third intermediate feed stream 704 at a temperature of −21 degrees Fahrenheit (−29 degrees Celsius), and finally an LLP feed evaporator 784 to produce a pre-cooled natural gas stream 705 at a temperature of −45 degrees Fahrenheit (−43 degrees Celsius). The cooled liquefaction refrigerant 739 is cooled to similar temperatures in the HP Liquefaction refrigerant evaporator 785, MP Liquefaction refrigerant evaporator 786, LP Liquefaction refrigerant evaporator 787, and the LLP Liquefaction refrigerant evaporator 788.

The warm low pressure precooling refrigerant 714 at temperature of −50 degrees Fahrenheit (−46 degrees Celsius), pressure of 108 psia (7 bara), and flowrate of 21,450 lbmol/hr (9,730 kgmol/hr) is compressed in a four stage precooling refrigerant compressor 716 to produce compressed precooling refrigerant 715 at temperature of 122 degrees Fahrenheit (50 degrees Celsius) and pressure of 722 psia (50 bara).

An LP side stream 713 at temperature of −27 degrees Fahrenheit (−33 degrees Celsius) and pressure of 188 psia (13 bara), MP side stream 712 at temperature of 1 degrees Fahrenheit (−17 degrees Celsius) and pressure of 313 psia (22 bara), and HP side stream 711 at temperature of 29 degrees Fahrenheit (−2 degrees Celsius) and pressure of 780 psia (32 bara) are introduced to the precooling refrigerant compressor 716 at intermediate locations.

The compressed precooling refrigerant 715 is cooled by indirect heat exchange against ambient air in three heat exchangers, depicted by precooling refrigerant condenser 717 to produce the cooled precooling refrigerant 710 at a temperature of 90 degrees Fahrenheit (32 degrees Celsius). The cooled precooling refrigerant 710 is further cooled in an auxiliary refrigerant system 796 to produce a further cooled precooling refrigerant 797 at a temperature of 50 degrees Fahrenheit (10 degrees Celsius). The further cooled precooling refrigerant 797 is then divided into the first portion of the cooled precooling refrigerant 719 and the second portion of the cooled precooling refrigerant 761, which are used to provide cooling duty to the pre-treated feed stream 701 and the cooled liquefaction refrigerant 739 respectively. The first portion of the cooled precooling refrigerant 719 is about 20 mole percent of the cooled precooling refrigerant 710.

The first portion of the cooled precooling refrigerant 719 is let down in pressure in a first pressure letdown valve 773 to produce a first HP precooling refrigerant 720 at a temperature of 29 degrees Fahrenheit (−1 degrees Celsius), pressure of 486 psia (33 bara), and vapor fraction of 0.12. The second portion of the cooled precooling refrigerant 761 is letdown to similar conditions.

During the second period of time, the auxiliary refrigerant system 796 is optionally bypassed via the bypass precooling refrigerant 710A, which is at 64 degrees Fahrenheit (18 degrees Celsius).

In contrast, now referring to FIG. 4 of the prior art, the first HP precooling refrigerant 420 is at a temperature of 62 degrees Fahrenheit (17 degrees Celsius), pressure of 766 psia (53 bara), and vapor fraction of 0.28. Also, the compressed precooling refrigerant 415 is at a temperature of 160 degrees Fahrenheit (71 degrees Celsius) and pressure of 1228 psia (85 bar). Further, the cooled precooling refrigerant 410 is at a temperature of 90 degrees Fahrenheit (32 degrees Celsius).

Since the critical temperature of ethane and carbon dioxide is about 30 degrees Celsius, the process of the prior art would have transcritical operation at average ambient temperature, which is the cause for the higher vapor fraction of the first HP precooling refrigerant 420. The embodiments, however would have subcritical operation, given that the temperature of the further cooled precooling refrigerant 797 is lower than the critical temperature. This is the reason for the lower vapor fraction of the first HP precooling refrigerant 720. By reducing the vapor fraction of first HP precooling refrigerant 720, the embodiments significantly improve the process efficiency.

Further, by lowering the pressure of the compressed precooling refrigerant 715, the embodiments reduce the compression power requirement and the specific heat ratio of the precooling refrigerant. Lower specific heat ratio also increases the process efficiency. Overall, up to about 20% improvement in process efficiency was observed for FIG. 7 as compared to FIG. 4, during the first period of time. Additionally, refrigerant inventory management issues associated with ambient temperature swings are also eliminated by the embodiments. Overall, the embodiments solve the challenges presented by transcritical refrigerants.

Example 3

The following is an example of an exemplary embodiment. The example process and data are based on simulations of a precooling and liquefaction process at a plant that produces nominally 5 MTPA of LNG. The precooling refrigerant for this example is either ethane or carbon dioxide and the liquefaction refrigerant may be either MR or N2. This example specifically refers to the embodiment shown in FIG. 12B.

The cooled precooling refrigerant 1210 is at 89.6 degrees Fahrenheit (32 degrees Celsius), 120 psia (84 bara), and vapor fraction of 1. The cooled precooling refrigerant 1210 is then divided into two portions, a first portion 1219 to provide cooling duty to the pre-treated feed stream 1201, and a second portion 1261 to provide cooling duty to the cooled liquefaction refrigerant 1239. The first portion of the cooled precooling refrigerant 1219 is let down in pressure in a first dual phase expander 1248A to produce a first HP precooling refrigerant 1220 at 59 degrees Fahrenheit (15 degrees Celsius), 735 psia (51 bara), and a vapor fraction of 0.25. In case a JT valve (isenthalpic) instead of the dual phase expander valve (isentropic) would have been used, the vapor fraction of the first HP precooling refrigerant 1220 would have been 0.3. The embodiment of FIG. 12B improves the process efficiency of the prior art by about 3%.

An invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method for cooling a hydrocarbon feed stream against a first refrigerant to produce a cooled hydrocarbon stream, the first refrigerant having a critical temperature, the method comprising:

(a) compressing the first refrigerant in at least one compression stage to produce a compressed first refrigerant;

(b) cooling the compressed first refrigerant against an ambient fluid in at least one heat exchanger to produce a cooled first refrigerant having a first temperature that is greater than or equal to the critical temperature of the first refrigerant;

(c) further cooling the cooled first refrigerant in at least one auxiliary heat exchanger to produce a further cooled first refrigerant at a second temperature that is less than the critical temperature of the first refrigerant; and (d) cooling a fluid stream in each of at least one cooling circuit located in downstream fluid flow communication from the auxiliary heat exchanger, each of the at least one cooling circuit having at least one evaporation stage, each of the following steps being performed in each evaporation stage:

(i) reducing the pressure of the first refrigerant;

(ii) cooling the fluid stream against the reduced pressure first refrigerant in an evaporator, resulting in vaporization of at least a portion of the reduced pressure first refrigerant; and (iii) flowing at least a portion of the vaporized reduced pressure first refrigerant into one of the at least one compression stages;

wherein at least one fluid stream being cooled in the at least one cooling circuit comprises the hydrocarbon feed stream and step (d) produces a cooled hydrocarbon stream; and wherein refrigeration duty for the at least one auxiliary heat exchanger is provided by at least one auxiliary refrigerant, the at least one auxiliary refrigerant being the hydrocarbon feed stream.

2. The method of claim 1, further comprising:

(e) further cooling and liquefying the cooled hydrocarbon stream in at least one liquefaction heat exchanger against a second refrigerant stream to produce a liquefied natural gas stream.

3. The method of claim 2, wherein the at least one fluid stream being cooled in the at least one cooling circuit comprises the second refrigerant.

4. The method of claim 1, wherein the first refrigerant comprises ethane, carbon-dioxide, or ethylene.

5. The method of claim 1, wherein step (a) further comprises:

(a) compressing the first refrigerant in a plurality of compression stages to produce the compressed first refrigerant.

6. The method of claim 5, wherein step (d) further comprises cooling at least one fluid stream in a plurality of evaporation stages located downstream from the economizer, wherein the steps (d)(i) through (d)(iii) are performed in each of the plurality of evaporation stages.

7. The method of claim 1, further comprising:

(e) combining a vapor phase portion of the warmed first refrigerant with the vaporized reduced pressure first refrigerant in one of the at least one evaporation stage before performing step (d)(iii).

8. The method of claim 7, further comprising:

(f) separating the warmed first refrigerant into the vapor phase portion and a liquid phase portion and performing step (d) using the liquid phase portion.

* * * * *